US010988713B2

(12) United States Patent
Schilling et al.

(10) Patent No.: US 10,988,713 B2
(45) Date of Patent: Apr. 27, 2021

(54) COMPOSITION CONTAINING PEPTIDASE AND BIOSURFACTANT

(71) Applicant: Evonik Operations GmbH, Essen (DE)

(72) Inventors: Martin Schilling, Bonn (DE); Ilona Davids, Kerken (DE); Monica Desiree van Logchem, Zevenbergen (NL); Hans Henning Wenk, Mülheim an der Ruhr (DE)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 15/548,602

(22) PCT Filed: Mar. 11, 2016

(86) PCT No.: PCT/EP2016/055226
§ 371 (c)(1),
(2) Date: Aug. 3, 2017

(87) PCT Pub. No.: WO2016/146497
PCT Pub. Date: Sep. 22, 2016

(65) Prior Publication Data

US 2018/0023040 A1 Jan. 25, 2018

(30) Foreign Application Priority Data

Mar. 18, 2015 (EP) ..... 15159546

(51) Int. Cl.

| | |
|---|---|
| ***C11D 3/386*** | (2006.01) |
| ***C11D 1/83*** | (2006.01) |
| ***C11D 1/66*** | (2006.01) |
| ***C11D 1/06*** | (2006.01) |
| ***C11D 1/02*** | (2006.01) |
| ***C11D 1/22*** | (2006.01) |

(52) U.S. Cl.
CPC ..... *C11D 3/386* (2013.01); *C11D 1/83* (2013.01); *C11D 3/38663* (2013.01); *C11D 1/02* (2013.01); *C11D 1/06* (2013.01); *C11D 1/22* (2013.01); *C11D 1/662* (2013.01); *C11D 1/667* (2013.01)

(58) Field of Classification Search
CPC ..... C11D 3/386; C11D 1/83; C11D 3/38663; C11D 1/02; C11D 1/662; C11D 1/06
See application file for complete search history.

(56) References Cited

U.S. PATENT DOCUMENTS

| | | | |
|---|---|---|---|
| 3,553,139 | A | 1/1971 | McCarty |
| 4,261,868 | A | 4/1981 | Hora et al. |
| 4,305,961 | A | 12/1981 | Tsutsumi et al. |
| 5,156,773 | A | 10/1992 | Kochavi et al. |
| 5,998,344 | A | 12/1999 | Christensen et al. |
| 7,556,654 | B1 | 7/2009 | Nero |
| 7,985,722 | B2 | 7/2011 | Desanto |
| 8,497,234 | B2 | 7/2013 | Mayer et al. |
| 8,911,982 | B2 | 12/2014 | Schaffer et al. |
| 9,068,211 | B2 | 6/2015 | Schaffer et al. |
| 9,085,787 | B2 | 7/2015 | Schaffer et al. |
| 9,102,968 | B2 | 8/2015 | Schaffer et al. |
| 9,157,108 | B2 | 10/2015 | Schaffer et al. |
| 2004/0171512 | A1 | 9/2004 | Furuta et al. |
| 2009/0170745 | A1 | 7/2009 | Merkel et al. |
| 2011/0201536 | A1 | 8/2011 | O'Connell et al. |
| 2013/0072414 | A1 | 3/2013 | Price et al. |
| 2014/0148375 | A1 | 5/2014 | Urbin et al. |
| 2014/0296168 | A1 | 10/2014 | Schilling et al. |

FOREIGN PATENT DOCUMENTS

| | | | |
|---|---|---|---|
| CN | 1337439 | | 2/2002 |
| CN | 103797102 | A | 5/2014 |
| DE | 2939519 | A1 | 4/1980 |
| DE | 19600743 | A1 | 7/1997 |
| DE | 19648439 | A1 | 5/1998 |
| DE | 102007005419 | A1 | 7/2008 |
| EP | 0499434 | A1 | 8/1992 |
| EP | 1445302 | A1 | 8/2004 |
| EP | 1411111 | B1 | 9/2008 |
| EP | 2410039 | A1 | 1/2012 |
| EP | 2501813 | A2 | 9/2012 |
| EP | 2786743 | A1 | 10/2014 |
| EP | 2787065 | A1 | 10/2014 |
| FR | 2740779 | A1 | 5/1997 |
| FR | 2855752 | A1 | 12/2004 |
| JP | 01304034 | | 12/1989 |
| JP | 2006070231 | | 3/2006 |
| JP | 2006083238 | | 3/2006 |
| JP | 2006274233 | | 10/2006 |
| JP | 2007181789 | | 7/2007 |
| JP | 2008062179 | | 3/2008 |
| KR | 2004033376 | | 12/2006 |
| WO | WO1989006270 | A1 * | 7/1989 |
| WO | 92/21760 | A1 | 12/1992 |
| WO | 93/07263 | A2 | 4/1993 |
| WO | 03002700 | A1 | 1/2003 |

(Continued)

OTHER PUBLICATIONS

Whisstock et al. Quaterly Reviews of Biophysics, 2003, "Prediction of protein function from protein sequence and structure", 36(3): 307-340.*

(Continued)

*Primary Examiner* — Iqbal H Chowdhury
(74) *Attorney, Agent, or Firm* — Taylor English Duma LLP; Philip P. McCann

(57) ABSTRACT

The invention relates to compositions comprising at least one protease and at least one biosurfactant, particularly selected from rhamnolipids and sophorolipids. In particular, the present invention is directed to a composition including A) at least one peptidase, B) at least one biosurfactant, and optionally C) at least one anionic surfactant. The peptidase may be selected from the group of the proteases, particularly from the group of the serine proteases of EC 3.4.21 and the metalloproteases of EC 3.4.24 and the biosurfactant may be selected from the group comprising rhamnolipids and sophorolipids.

13 Claims, 12 Drawing Sheets

(56) References Cited

FOREIGN PATENT DOCUMENTS

| | | | |
|---|---|---|---|
| WO | 03006146 | A1 | 1/2003 |
| WO | 03/057713 | A2 | 7/2003 |
| WO | 2007115872 | A1 | 10/2007 |
| WO | 2007/131656 | A1 | 11/2007 |
| WO | 2011061032 | A2 | 5/2011 |
| WO | 2012010406 | A1 | 1/2012 |
| WO | 2013043857 | A1 | 3/2013 |
| WO | 2014118095 | A2 | 8/2014 |

OTHER PUBLICATIONS

Witkowski et al. Conversion of a beta-ketoacyl synthase to a malonyl decarboxylase by replacement of the active-site cysteine with glutamine, Biochemistry. Sep. 7, 1999;38(36): 11643-50.*
German language International Search Report dated May 18, 2016 in PCT/EP2016/055226 (4 pages).
German Language Written Opinion dated May 18, 2016 in PCT/EP2016/055226 (5 pages).
International Search Report dated May 18, 2016 in PCT/EP2016/055226 (3 pages).
Peggau et al., U.S. Appl. No. 15/509,685, filed Mar. 8, 2017.
Scheuermann et al., U.S. Appl. No. 15/546,297, filed Jul. 26, 2017.
Schilling et al., U.S. Appl. No. 15/520,157, filed Apr. 19, 2017.

* cited by examiner

COMPOSITION CONTAINING PEPTIDASE AND BIOSURFACTANT

This application is a national stage application under 35 U.S.C. § 371 of International Application No. PCT/EP2016/055226 filed 11 Mar. 2016, which claims priority to EP Application No. 15159546.9 filed 18 Mar. 2015, the disclosures of which are expressly incorporated herein by reference.

FIELD

The invention relates to compositions comprising at least one peptidase and at least one biosurfactant, particularly selected from rhamnolipids and sophorolipids.

BACKGROUND

Proteases are used in washing, cleaning and rinsing compositions and, by means of the biocatalytic degradation, contribute to the dissolution of the dirt and thus to the cleaning performance. The stability of the proteases in the mostly anionic surfactant systems is still a challenge for the formulator, especially if liquid formulations are to be produced which are storage-stable over a long period of time and should retain their enzymatic activity. In principle, surfactants contribute to the denaturation of proteins and thus of the enzyme structure and thereby cause inactivation of the enzyme activity.

Enzyme producers use protein engineering methods to develop enzymes having increased stability with respect to surfactants. However, this is complex, not successful for all enzymes and may lead to a decreased specific activity due to the altered protein structure.

Alternatively, enzymes may be stabilised by using milder surfactants. For instance, sodium lauryl ether sulphate and/or fatty alcohol ethoxylates are added to the linear alkylbenzene sulphonates used as main surfactant, cf. Kravetz et al. 1985, Lund et al. 2012.

According to U.S. Pat. No. 5,156,773, betaines may also be used to stabilise proteases with respect to anionic surfactants.

DE102007005419 discloses nitrogen-containing, nonionic over a wide range amine oxides as enzyme-stabilising.

EP0499434, EP2787065 and EP2410039 disclose rhamnolipids and sophorolipids, alone or in combination with other anionic surfactants, and their good cleaning effect on laundry.

A good cleaning effect of rhamnolipids in combination with lipases is described in the examples of WO2012010406. In this case, no formulations are used comprising in addition a further anionic surfactant.

In the formulation of liquid surfactant systems with enzymes also comprising protease activity, it must also be ensured that the protease activity in the formulation is inhibited by suitable additives, since otherwise autodigestion of the proteases or even digestion of other enzymes in the formulation is possible. For this purpose, polyols (e.g. 1,2-propanediol), borates and other inhibitors are used. The borates, in particular, have fallen into disrepute in recent years due to toxicological concerns and there still exists a need for an inexpensive, toxicologically acceptable substitute.

SUMMARY

It has been found, surprisingly, that the stability of peptidases, particularly in anionic surfactant systems, can be increased by the addition of biosurfactants, in particular, rhamnolipids and sophorolipids. Furthermore, the amount of protease inhibitor otherwise required may be reduced, or the protease inhibitor may even be completely dispensed with.

BRIEF DESCRIPTION OF THE DRAWINGS

FIG. 4).

FIG. 4).

DETAILED DESCRIPTION

Figure 1:
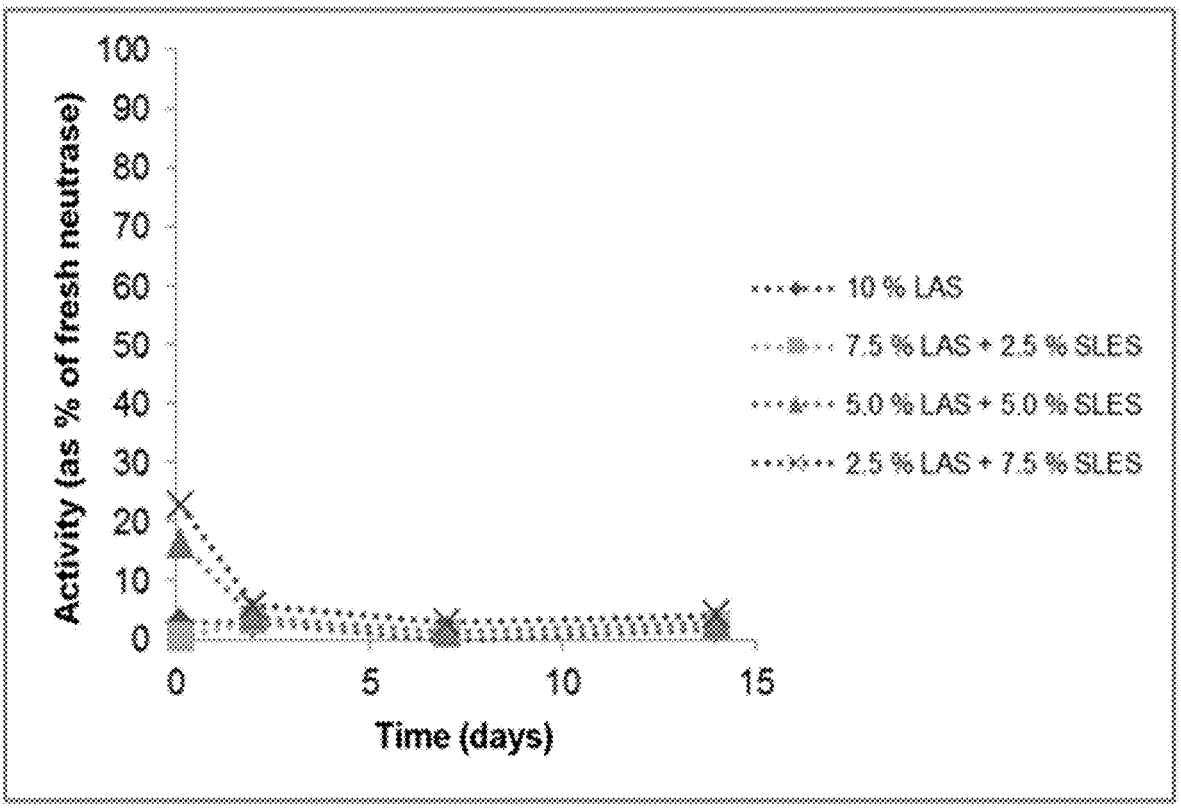
FIG. 1: Influence of addition of sodium lauryl ether sulphate (SLES) on the storage stability of Neutrase® 0.8 L in a formulation with linear alkylbenzenesulphonate (LAS) (cf. Table 1). Plot of the activity compared to the enzyme stored in a refrigerator. SLES barely contributes to the stabilization of the enzyme.

The present invention therefore relates to compositions comprising

A) at least one peptidase,

B) at least one biosurfactant, and optionally

C) at least one anionic surfactant.

An advantage of the composition according to the invention is that the proportion of surfactants present therein, based on renewable raw materials, is preferably more than 50% by weight, based on the total amount of surfactants present in the composition.

A further advantage of the composition according to the invention is that sugars or sugars and glycerides and/or fatty acids can be used as raw materials for the biosurfactants.

A further advantage of the composition according to the invention is that it is very mild.

Another advantage of the present invention is that, in the compositions according to the invention, the amount of protease inhibitor required may be reduced or the protease inhibitor may even be completely dispensed with.

A further advantage compared to the prior art is the increased stability of the enzymes during the washing process, and the improved cleaning performance linked thereto, for example, in laundry.

Another advantage of the present invention is that, in the compositions according to the invention, proteases may also be used for which the stability in detergent formulations has hitherto been insufficient.

Another advantage of the present invention is that no or fewer complexing agents (builders) have to be used to ensure adequate washing performance in hard water.

The compositions according to the invention, and uses thereof are described below by way of example without any intention of limiting the invention to these exemplary embodiments. Where ranges, general formulae or compound classes are specified hereinbelow, these are intended to include not only the relevant ranges or groups of compounds explicitly mentioned but also all subranges and subgroups of compounds that may be obtained by extracting individual values (ranges) or compounds. Where documents are cited in the context of the present description, their content shall fully belong to the disclosure content of the present invention, particularly in respect of the factual position in the context of which the document was cited. Where average values are stated hereinbelow, then, unless stated otherwise, these are number-averaged average values. Unless stated otherwise, percentages are data in percent by weight. Wherever measurement values are stated hereinbelow, then, unless stated otherwise, these have been determined at a temperature of 25° C. and a pressure of 1013 mbar.

In connection with the present invention, the term "anionic surfactant" is understood as meaning a surfactant in which, at a pH of 7 and 20° C., at least 90 mol % of the molecules have at least one negatively charged group. Preferably, they have no isoelectric point of $pH_{IEP}$=2-12 at 25° C., measurement being made in an aqueous 10 millimolar potassium chloride solution as background electrolyte.

In the context of the present invention, the term "stabilising an enzyme activity" is particularly understood to mean that the enzyme under consideration, when stored at 30° C. for a period so long that a loss of activity occurs, loses less activity in the presence of the stabiliser, in this case the biosurfactant, compared to the activity lost under otherwise identical conditions in the absence of the stabiliser.

The composition according to the invention comprises at least one peptidase as component A). Peptidases are enzymes of the enzyme class ("EC") 3.4.

The peptidases present are preferably selected from the group of the proteases. All known proteases from the prior art are suitable as proteases, including chemically or genetically modified proteases. These include, in particular, the serine proteases of EC 3.4.21 and metalloproteases of EC 3.4.24. Peptidases present are preferably the trypsins and chymotrypsin-like proteases of EC 3.4.21.1, EC 3.4.21.2 and EC 3.4.21.4 and especially preferably the subtilisins of EC 3.4.21.62. Metalloproteases particularly preferably present are selected from the group of the thermolysines of EC 3.4.24.27 and the bacillolysines of EC 3.4.24.28.

Examples of commercially available proteases include Kannase™, Everlase™, Esperase™, Alcalase™, Neutrase™, Durazym™, Savinase™, Ovozyme™, Liquanase™, Co-ronase™, Polarzyme™, Pyrase™, Pancreatic Trypsin NOVO (PTN), Bio-Feed™ Pro and Clear-Lens™ Pro (all from Novozymes A/S, Bagsvaerd, Denmark). Other commercially available proteases include Ronozyme™ Pro, Maxatase™, Maxacal™, Maxapem™, Optic-lean™, Properase™, Purafect™ Purafect Ox™ Purafact Prime™ Excellase™ FN2™ FN 3™ and FN4™ (Genencor International Inc., Gist-Brocades, BASF, DSM). Henkel/Kemira proteases are also suitable, such as BLAP (sequence in FIG. 29 of U.S. Pat. No. 5,352,604 with the following point mutations: S99D+S101 R+S103A+V104I+G159S, referred to hereinafter as BLAP), BLAP R (BLAP S3T+V4I+V199M+V205I+L217D), BLAP X (BLAP with the following point mutations: S3T+V4I+V205I) and BLAP F49 (BLAP with the following point mutations: S3T+V4I+A194P+V199M+V205I+L217D) and KAP (*Bacillus alkalophilus* subtilisin with the following point mutations: A230V+S256G+S259N from Kao.

Within the context of the present invention, biosurfactants are understood as meaning all glycolipids produced by fermentation.

Raw materials for producing the biosurfactants that can be used are carbohydrates, in particular sugars such as e.g. glucose and/or lipophilic carbon sources such as fats, oils, partial glycerides, fatty acids, fatty alcohols, long-chain saturated or unsaturated hydrocarbons. Preferably, in the compositions according to the invention, no biosurfactants are present which are not produced by fermentation of glycolipids, such as e.g. lipoproteins.

The composition according to the invention preferably comprises as component B) at least one biosurfactant rhamnolipids, sophorolipids, glucose lipids, cellulose lipids, mannosylerythritol lipids and/or trehalose lipids, preferably rhamnolipids and/or sophorolipids. The biosurfactants, in particular glycolipid surfactants, can be produced e.g. as in EP 0 499 434, U.S. Pat. No. 7,985,722, WO 03/006146, JP 60 183032, DE 19648439, DE 19600743, JP 01 304034, CN 1337439, JP 2006 274233, KR 2004033376, JP 2006 083238, JP 2006 070231, WO 03/002700, FR 2740779, DE 2939519, U.S. Pat. No. 7,556,654, FR 2855752, EP 1445302, JP 2008 062179 and JP 2007 181789 or the documents cited therein. Suitable biosurfactants can be acquired e.g. from Soliance, France.

Preferably, the composition according to the invention has, as biosurfactants, rhamnolipids, in particular mono-, di- or polyrhamnolipids and/or sophorolipids. Particularly preferably, the composition according to the invention has one or more of the rhamnolipids and/or sophorolipids described in EP 1 445 302 A with the formulae (I), (II) or (III).

The term "rhamnolipid" in the context of the present invention is understood to mean particularly compounds of the general formula (I) or salts thereof, Formula (I)

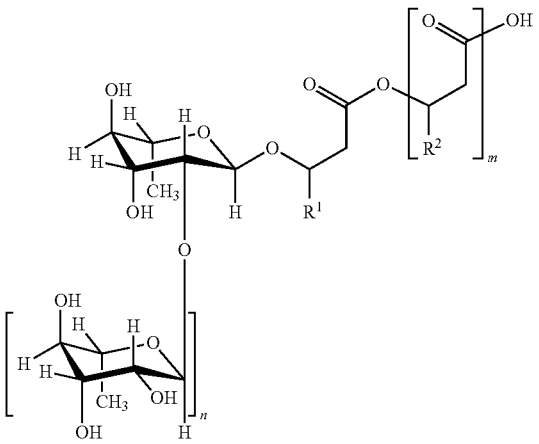

where m=2, 1 or 0, n=1 or 0, $R^1$ and $R^2$=mutually independently, identical or different, organic residues having 2 to 24, preferably 5 to 13 carbon atoms, in particular optionally branched, optionally substituted, particularly hydroxy-substituted, optionally unsaturated, in particular optionally mono-, bi- or tri-unsaturated alkyl residues, preferably those selected from the group consisting of pentenyl, heptenyl, nonenyl, undecenyl and tridecenyl and $(CH_2)_o$—$CH_3$ where o=1 to 23, preferably 4 to 12.

The term "di-rhamnolipid" in the context of the present invention is understood to mean compounds of the general formula (I) or salts thereof, where n=1.

The term "mono-rhamnolipid" in the context of the present invention is understood to mean compounds of the general formula (I) or salts thereof, where n=0.

Distinct rhamnolipids are abbreviated according to the following nomenclature: "diRL-CXCY" are understood to mean di-rhamnolipids of the general formula (I), in which one of the residues $R^1$ and $R^2$=$(CH_2)_o$—$CH_3$ where o=X-4 and the remaining residue $R^1$ or $R^2$=$(CH_2)_o$—$CH_3$ where o=Y-4.

"monoRL-CXCY" are understood to mean mono-rhamnolipids of the general formula (I), in which one of the residues $R^1$ and $R^2$=$(CH_2)_o$—$CH_3$ where o=X-4 and the remaining residue $R^1$ or $R^2$=$(CH_2)_o$—$CH_3$ where o=Y-4.

The nomenclature used therefore does not distinguish between "CXCY" and "CYCX".

For rhamnolipids where m=0, monoRL-CX or diRL-CX is used accordingly.

If one of the abovementioned indices X and/or Y is provided with ":Z", this signifies that the respective residue $R^1$ and/or $R^2$ is equal to an unbranched, unsubstituted hydrocarbon residue having X-3 or Y-3 carbon atoms having Z double bonds.

To determine the content of rhamnolipids in the context of the present invention, only the mass of the rhamnolipid anion is considered, i.e. "general formula (I) less one hydrogen".

To determine the content of rhamnolipids in the context of the present invention, all rhamnolipids are converted by acidification into the protonated form (cf. general formula (I)) and quantified by HPLC.

The rhamnolipids present in the compositions according to the invention are present at least partially as salts on account of the given pH.

In preferred compositions according to the invention the cations of the rhamnolipid salts present are selected from the group comprising, preferably consisting of, $Li^+$, $Na^+$, $K^+$, $Mg^{2+}$, $Ca^{2+}$, $Al^{3+}$, $NH_4^+$, primary ammonium ions, secondary ammonium ions, tertiary ammonium ions and quaternary ammonium ions.

Exemplary representatives of suitable ammonium ions are tetramethylammonium, tetraethylammonium, tetrapropylammonium, tetrabutylammonium and [(2-hydroxyethyl) trimethylammonium] (choline) and also the cations of 2-aminoethanol (ethanolamine, MEA), diethanolamine (DEA), 2,2',2"-nitrilotriethanol (triethanolamine, TEA), 1-aminopropan-2-ol (monoisopropanolamine), ethylenediamine, diethylenetriamine, triethylenetetramine, tetraethylenepentamine, 1,4-diethylenediamine (piperazine), aminoethylpiperazine and aminoethylethanolamine.

Mixtures of the abovementioned cations may also be present as cations of the rhamnolipid salts present according to the invention.

Particularly preferred cations are selected from the group comprising, preferably consisting of, $Na^+$, $K^+$, $NH_4^+$ and the triethanolammonium cation.

A preferred composition according to the invention is characterized in that it comprises a mixture of rhamnolipids, wherein the ratio by weight of di-rhamnolipids to mono-rhamnolipids is greater than 51:49, preferably greater than 75:25, particularly preferably 97:3, in particular greater than 98:2 in the mixture.

A preferred composition according to the invention is characterized in that the rhamnolipid mixture comprises 51% by weight to 95% by weight, preferably 70% by weight to 90% by weight, particularly preferably 75% by weight to 85% by weight, of diRL-C10C10 and 0.5% by weight to 9% by weight, preferably 0.5% by weight to 3% by weight, particularly preferably 0.5% by weight to 2% by weight, of monoRL-C10C10, where the percentages by weight refer to the sum total of all rhamnolipids present.

A preferred composition according to the invention is characterized in that the rhamnolipid mixture, in addition to the diRL-C10C10 and monoRL-C10C10 content mentioned above, comprises 0.5% by weight to 15% by weight, preferably 3% by weight to 12% by weight, particularly preferably 5% by weight to 10% by weight, of diRL-C10C12:1, where the percentages by weight refer to the sum total of all rhamnolipids present.

A preferred composition according to the invention is characterized in that the rhamnolipid mixture, in addition to the diRL-C10C10 and monoRL-C10C10 content mentioned above, comprises 0.1% by weight to 5% by weight, preferably 0.5% by weight to 3% by weight, particularly preferably 0.5% by weight to 2% by weight, of monoRL-C10C12 and/or, preferably and 0.1% by weight to 5% by weight, preferably 0.5% by weight to 3% by weight, particularly preferably 0.5% by weight to 2% by weight, of monoRL-C10C12:1, where the percentages by weight refer to the sum total of all rhamnolipids present.

It can be advantageous and is therefore preferred if the rhamnolipid mixture present in the composition according to the invention, in addition to the diRL-C10C10 and monoRL-C10C10 content mentioned above, comprises 0.1% by weight to 25% by weight, preferably 2% by weight to 10% by weight, particularly preferably 4% by weight to 8% by weight, of diRL-C8C10, where the percentages by weight refer to the sum total of all rhamnolipids present.

A particularly preferred composition according to the invention is characterized in that the rhamnolipid mixture, in addition to the diRL-C10C10 and monoRL-C10C10 content mentioned above, comprises 0.5% by weight to 15% by weight, preferably 3% by weight to 12% by weight, particularly preferably 5% by weight to 10% by weight, of diRL-C10C12:1, 0.5 to 25% by weight, preferably 5% by weight to 15% by weight, particularly preferably 7% by weight to 12% by weight, of diRL-C10C12, 0.1% by weight to 5% by weight, preferably 0.5% by weight to 3% by weight, particularly preferably 0.5% by weight to 2% by weight, of monoRL-C10C12 and 0.1% by weight to 5% by weight, preferably 0.5% by weight to 3% by weight, particularly preferably 0.5% by weight to 2% by weight, of monoRL-C10C12:1, where the percentages by weight refer to the sum total of all rhamnolipids present.

It is moreover preferred if the rhamnolipid mixture present in the composition according to the invention comprises only small amounts of rhamnolipids of the formula monoRL-CX or diRL-CX. In particular, the composition mixture according to the invention preferably comprises 0% by weight to 5% by weight, preferably 0.001% by weight to 3% by weight, particularly preferably 0.01% by weight to 1% by weight, of diRLC10, where the percentages by weight refer to the sum total of all rhamnolipids present, and the term "0% by weight" is understood to mean no detectable amount.

Methods for preparing the relevant rhamnolipid mixtures are disclosed, for example, in EP2786743 and EP2787065.

Sophorolipids may be used in accordance with the invention in their acid form or their lactone form. The term "acid form" of sophorolipids refers to the general formula (Ia) of EP2501813 and the term "lactone form" refers to the general formula (Ib) of EP2501813.

To determine the content of sophorolipids in the acid or lactone form in a formulation, refer to EP 1 411 111 B1, page 8, paragraph [0053].

Preferred formulations according to the invention comprise a sophorolipid as component B) in which the ratio by weight of lactone form to acid form is in the range of 20:80 to 80:20, especially preferably in the ranges of 30:70 to 40:60.

The composition according to the invention preferably comprises at least one anionic surfactant as component C).

Preferably, anionic surfactants present in the composition according to the invention are selected from the group comprising, preferably consisting of, alkyl sulphates, alkyl ether sulphates, optionally alkoxylated sulphosuccinates, optionally alkoxylated methylsulphosuccinates, optionally alkoxylated sulphonates, optionally alkoxylated glycinates, optionally alkoxylated glutamates, optionally alkoxylated isethionates, optionally alkoxylated carboxylates, optionally alkoxylated anisates, optionally alkoxylated levulinates, optionally alkoxylated tartrates, optionally alkoxylated lactylates, optionally alkoxylated taurates, optionally alkoxylated alaninates, optionally alkoxylated phosphates, optionally alkoxylated sulphoacetates, optionally alkoxylated sulphosuccinamates, optionally alkoxylated sarcosinates and optionally alkoxylated phosphonates.

Preferably, alkyl sulphates or alkyl ether sulphates present as anionic surfactant in the composition according to the invention are selected from the group consisting of C4- to C24-, preferably C6- to C18-, particularly preferably C8- to C14-, alkyl sulphates and alkyl ether sulphates. The alkyl residues can be linear or branched, with linear being preferred. Suitable branched alkyl residues include methyldecyl groups, methylundecyl groups, methyldodecyl groups, ethyldecyl groups, ethylundecyl groups and ethyldodecyl groups, such as for example 1-methyldecyl, 1-methylundecyl, 1-methyldodecyl, 1-ethyldecyl, 1-ethylundecyl and 1-ethyldodecyl.

The addition of an alkyl or alkenyl group with the suffix "eth" describes in general the addition of one or more ethylene oxide units, for example trideceth refers to an ethoxylated tridecyl group, and the suffix "-n", where n is an integer, the number of such ethylene oxide units per group, for example "Trideceth-3" refers to a group of ethoxylated tridecyl alcohol with 3 ethylene oxide units per tridecyl group.

In a preferred embodiment, the alkyl sulphate or alkyl ether sulphate is selected from Ammonium C12-15 Alkyl Sulphate, Ammonium C12-16 Alkyl Sulphate, Ammonium Capryleth Sulphate, Ammonium Cocomonoglyceride Sulphate, Ammonium Coco Sulphate, Ammonium C12-15 Pareth Sulphate, Ammonium Laureth Sulphate, Ammonium Laureth-5 Sulphate, Ammonium Laureth-7 Sulphate, Ammonium Laureth-9 Sulphate, Ammonium Laureth-12 Sulphate, Ammonium Lauryl Sulphate, Ammonium Myreth Sulphate, Ammonium Myristyl Sulphate, Ammonium Nonoxynol-4 Sulphate, Ammonium Nonoxynol-30 Sulphate, Ammonium Palm Kernel Sulphate, Ammonium Trideceth Sulphate, DEA-C12-13 Alkyl Sulphate, DEA-C12-15 Alkyl Sulphate, DEA-Cetyl Sulphate, DEA-C12-13 Pareth-3 Sulphate, DEA-Laureth Sulphate, DEA-Lauryl Sulphate, DEA-Myreth Sulphate, DEA-Myristyl Sulphate, DEA-Trideceth Sulphate, Diethylamine Laureth Sulphate, Magnesium Coceth Sulphate, Magnesium Coco Sulphate, Magnesium Laureth Sulphate, Magnesium Laureth-5 Sulphate, Magnesium Laureth-8 Sulphate, Magnesium Laureth-16 Sulphate, Magnesium Lauryl Sulphate, Magnesium Myreth Sulphate, Magnesium Oleth Sulphate, Magnesium PEG-3 Cocamide Sulphate, Magnesium/TEA Coco Sulphate, MEA-Laureth Sulphate, MEA-Lauryl Sulphate, MEA-Trideceth Sulphate, MIPA C12-15 Pareth Sulphate, MIPA-Laureth Sulphate, MIPA-Lauryl Sulphate, MIPA-Trideceth Sulphate, Mixed Isopropanolamines Lauryl Sulphate, Potassium Laureth Sulphate, Potassium Lauryl Sulphate, Sodium C8-10 Alkyl Sulphate, Sodium C10-16 Alkyl Sulphate, Sodium C11-15 Alkyl Sulphate, Sodium C12-13 Alkyl Sulphate, Sodium C12-15 Alkyl Sulphate, Sodium C12-18 Alkyl Sulphate, Sodium C16-20 Alkyl Sulphate, Sodium Caprylyl Sulphate, Sodium Cetearyl Sulphate, Sodium Cetyl Sulphate, Sodium Cholesteryl Sulphate, Sodium Coceth Sulphate, Sodium Coceth-30 Sulphate, Sodium Coco/Hydrogenated Tallow Sulphate, Sodium Cocomonoglyceride Sulphate, Sodium Coco Sulphate, Sodium C9-15 Pareth-3 Sulphate, Sodium C10-15 Pareth Sulphate, Sodium C10-16 Pareth-2 Sulphate, Sodium C12-13 Pareth Sulphate, Sodium C12-14 Pareth-3 Sulphate, Sodium C12-15 Pareth Sulphate, Sodium C12-15 Pareth-3 Sulphate, Sodium C13-15 Pareth-3 Sulphate, Sodium C12-14 Sec-Pareth-3 Sulphate, Sodium Deceth Sulphate, Sodium Decyl Sulphate, Sodium Ethylhexyl Sulphate, Sodium Laneth Sulphate, Sodium Laureth Sulphate, Sodium Laureth-5 Sulphate, Sodium Laureth-7 Sulphate, Sodium Laureth-8 Sulphate, Sodium Laureth-12 Sulphate, Sodium Laureth-40 Sulphate, Sodium Lauryl Sulphate, Sodium/MEA-PEG-3 Cocamide Sulphate, Sodium Myreth Sulphate, Sodium Myristyl Sulphate, Sodium Nonoxynol-1 Sulphate, Sodium Nonoxynol-3 Sulphate, Sodium Nonoxynol-4 Sulphate, Sodium Nonoxynol-6 Sulphate, Sodium Nonoxynol-8 Sulphate, Sodium Nonoxynol-10 Sulphate, Sodium Nonoxynol-25 Sulphate, Sodium Octoxynol-2 Sulphate, Sodium Octoxynol-6 Sulphate, Sodium Octoxynol-9 Sulphate, Sodium Oleth Sulphate, Sodium Oleyl Sulphate, Sodium PEG-4 Cocamide Sulphate, Sodium PEG-4 Lauramide Sulphate, Sodium Stearyl Sulphate, Sodium Tallow Sulphate, Sodium/TEA C12-13 Pareth-3 Sulphate, Sodium Trideceth Sulphate, Sodium Tridecyl Sulphate, Sulphated Castor Oil, Sulphated Coconut Oil, Sulphated Glyceryl Oleate, Sulphated Olive Oil, Sulphated Peanut Oil, TEA-C10-15 Alkyl Sulphate, TEA-C11-15 Alkyl Sulphate, TEA-C12-13 Alkyl Sulphate, TEA-C12-14 Alkyl Sulphate, TEA-C12-15 Alkyl Sulphate, TEA-Coco Sulphate, TEA-C11-15 Pareth Sulphate, TEA-C12-13 Pareth-3 Sulphate, TEA-Laneth-5 Sulphate, TEA-Laureth Sulphate, TEA-Lauryl Sulphate, TEA-Oleyl Sulphate, TEA-PEG-3 Cocamide Sulphate, TEA-Trideceth Sulphate, TIPA-Laureth Sulphate, TIPA-Lauryl Sulphate, with Sodium Laureth Sulphate being very particularly preferred.

Preferably, optionally alkoxylated sulphosuccinates and/or methyl sulphosuccinates present as anionic surfactant in the composition according to the invention are selected from the group consisting of optionally alkoxylated C4- to C24-, preferably C6- to C18-, particularly preferably C8- to C14-, sulphosuccinates and/or methylsulphosuccinates. The sulphosuccinates and/or methylsulphosuccinates can contain one or two alkyl residues, monoalkyl sulphosuccinates and monomethyl sulphosuccinates are preferred. The alkyl residues can be linear or branched, with linear being preferred. Alkoxylated sulphosuccinates and/or methylsulphosuccinates can in particular have a degree of alkoxylation between 1 and 10, particularly preferably between 2 and 5.

The alkoxy group is preferably selected from ethoxy.

Particularly preferably, optionally alkoxylated sulphosuccinates present are selected from the group consisting of Disodium Laureth Sulphosuccinate, Disodium C12-14 Pareth-1 Sulphosuccinate, Disodium C12-14 Pareth-2 Sulphosuccinate, Disodium C12-14 Sec-pareth-12 Sulphosuccinate, Disodium C12-14 Sec-pareth-3 Sulphosuccinate, Disodium C12-14 Sec-pareth-5 Sulphosuccinate, Disodium C12-14 Sec-pareth-7 Sulphosuccinate, Disodium C12-14 Sec-pareth-9 Sulphosuccinate, Disodium C12-14 Pareth Sulphosuccinate, Di-Triethanolamine Oleamido PEG-2 Sulphosuccinate, Disodium Oleamido PEG-2 Sulphosuccinate, Disodium Cocamido Monoisopropanolamine PEG-4 Sulphosuccinate, Disodium Cocamido PEG-4 Sulphosuccinate, Disodium Coceth-3 Sulphosuccinate, Disodium Cocoyl Butyl Gluceth-10 Sulphosuccinate, Disodium Deceth-5 Sulphosuccinate, Disodium Deceth-6 Sulphosuccinate, Disodium Laneth-5 Sulphosuccinate, Disodium Lauramido PEG-2 Sulphosuccinate, Disodium Lauramido PEG-5 Sulphosuccinate, Disodium Laureth Sulphosuccinate, Disodium Laureth-12 Sulphosuccinate, Disodium Laureth-6 Sulphosuccinate, Disodium Laureth-9 Sulphosuccinate, Disodium Oleamido PEG-2 Sulphosuccinate, Disodium Oleth-3 Sulphosuccinate, Disodium Palmitamido PEG-2 Sulphosuccinate, Disodium PEG-5 Laurylcitrate Sulphosuccinate, Disodium PEG-8 Palm Glycerides Sulphosuccinate, Disodium Sitostereth-14 Sulphosuccinate, Disodium Undecylenamide PEG-2 Sulphosuccinate, Magnesium Laureth-3 Sulphosuccinate, Monoethanolamine Laureth-2 Sulphosuccinate, Diammonium C12-14 Pareth-1 Sulphosuccinate, Diammonium C12-14 Pareth-2 Sulphosuccinate, Diammonium C12-14 Sec-pareth-12 Sulphosuccinate, Diammonium C12-14 Sec-pareth-3 Sulphosuccinate, Diammonium C12-14 Sec-pareth-5 Sulphosuccinate, Diammonium C12-14 Sec-pareth-7 Sulphosuccinate, Diammonium C12-14 Sec-pareth-9 Sulphosuccinate, Diammonium C12-14 Pareth Sulphosuccinate, Di-Triethanolamine Oleamido PEG-2 Sulphosuccinate, Diammonium Oleamido PEG-2 Sulphosuccinate, Diammonium Cocamido Monoisopropanolamine PEG-4 Sulphosuccinate, Diammonium Cocamido PEG-4 Sulphosuccinate, Diammonium Coceth-3 Sulphosuccinate, Diammonium Cocoyl Butyl Gluceth-10 Sulphosuccinate, Diammonium Deceth-5 Sulphosuccinate, Diammonium Deceth-6 Sulphosuccinate, Diammonium Laneth-5 Sulphosuccinate, Diammonium Lauramido PEG-2 Sulphosuccinate, Diammonium Lauramido PEG-5 Sulphosuccinate, Diammonium Laureth Sulphosuccinate, Diammonium Laureth-12 Sulphosuccinate, Diammonium Laureth-6 Sulphosuccinate, Diammonium Laureth-9 Sulphosuccinate, Diammonium Oleamido PEG-2 Sulphosuccinate, Diammonium Oleth-3 Sulphosuccinate, Diammonium Palmitamido PEG-2 Sulphosuccinate, Diammonium PEG-5 Laurylcitrate Sulphosuccinate, Disodium PEG-8 Palm Glycerides Sulphosuccinate, Diammonium Sitostereth-14 Sulphosuccinate, Diammonium Undecylenamide PEG-2 Sulphosuccinate, Ammonium Lauryl Sulphosuccinate, Diammonium Lauramido-MEA Sulphosuccinate, Diammonium Lauryl Sulphosuccinate, Dipotassium Lauryl Sulphosuccinate, Di sodium Babassuamido MEA-Sulphosuccinate, Di sodium Cetearyl Sulphosuccinate, Disodium Cetyl Sulphosuccinate, Disodium Cocamido MEA-Sulphosuccinate, Disodium Cocamido MIPA-Sulphosuccinate, Di sodium Coco-Glucoside Sulphosuccinate, Di sodium Coco-Sulphosuccinate, Disodium Hydrogenated Cottonseed Glyceride Sulphosuccinate, Disodium Isodecyl Sulphosuccinate, Di sodium Isostearamido MEA-Sulphosuccinate, Di sodium Isostearamido MIPA-Sulphosuccinate, Disodium Isostearyl Sulphosuccinate, Disodium Lauramido MEA-Sulphosuccinate, Disodium Lauramido MIPA Glycol Sulphosuccinate, Disodium Lauryl Sulphosuccinate, Disodium Myristamido MEA-Sulphosuccinate, Disodium Oleamido MEA-Sulphosuccinate, Disodium Oleamido MIPA-Sulphosuccinate, Disodium Oleyl Sulphosuccinate, Di sodium Polyglyceryl-3 Caprate/Caprylate Sulphosuccinate, Di sodium Ricinoleamido MEA-Sulphosuccinate, Di sodium Stearamido MEA-Sulphosuccinate, Di sodium Stearyl Sulphosuccinate, Disodium Tallamido MEA-Sulphosuccinate, Disodium Tallowamido MEA-Sulphosuccinate, Disodium Tridecylsulphosuccinate, Disodium Undecylenamido MEA-Sulphosuccinate, Diethylhexyl Sodium Sulphosuccinate, Dinonyl Sodium Sulphosuccinate, Diisononyl Sodium Sulphosuccinate, Dioctyl Sodium Sulphosuccinate, Diheptyl Sodium Sulphosuccinate, Dihexyl Sodium Sulphosuccinate, Dineopentyl Sodium Sulphosuccinate, Diisoamyl Sodium Sulphosuccinate, Dipentyl Sodium Sulphosuccinate, Diamyl Sodium Sulphosuccinate, Dibutyl Sodium Sulphosuccinate, Diisobutyl Sodium Sulphosuccinate, Dicapryl Sodium Sulphosuccinate, Didecyl Sodium Sulphosuccinate, Diundecyl Sodium Sulphosuccinate, Dilauryl Sodium Sulphosuccinate, Dicocoyl Sodium Sulphosuccinate, Ditridecyl Sodium Sulphosuccinate, Dipropylheptyl Sodium Sulphosuccinate, Dicyclohexyl Sodium Sulphosuccinate, Ammonium Diethylhexyl Sulphosuccinate, Ammonium Dinonyl Sulphosuccinate, Ammonium Diisononyl Sulphosuccinate, Ammonium Dioctyl Sodium Sulphosuccinate, Ammonium Diheptyl Sulphosuccinate, Ammonium Dihexyl Sulphosuccinate, Ammonium Dineopentyl Sulphosuccinate, Ammonium Diisoamyl Sulphosuccinate, Ammonium Dipentyl Sulphosuccinate, Ammonium Diamyl Sulphosuccinate, Ammonium Dibutyl Sulphosuccinate, Ammonium Diisobutyl Sulphosuccinate, Ammonium Dicapryl Sulphosuccinate, Ammonium Didecyl Sulphosuccinate, Ammonium Diundecyl Sulphosuccinate, Ammonium Dilauryl Sulphosuccinate, Ammonium Dicocoyl Sulphosuccinate, Ammonium Ditridecyl Sulphosuccinate, Ammonium Dipropylheptyl Sulphosuccinate, Ammonium Dicyclohexyl Sulphosuccinate, Diethylhexyl Potassium Sulphosuccinate, Dinonyl Potassium Sulphosuccinate, Diisononyl Potassium Sulphosuccinate, Dioctyl Potassium Sulphosuccinate, Diheptyl Potassium Sulphosuccinate, Dihexyl Potassium Sulphosuccinate, Dineopentyl Potassium Sulphosuccinate, Diisoamyl Potassium Sulphosuccinate, Dipentyl Potassium Sulphosuccinate, Diamyl Potassium Sulphosuccinate, Dibutyl Potassium Sulphosuccinate, Diisobutyl Potassium Sulphosuccinate, Dicapryl Potassium Sulphosuccinate, Didecyl Potassium Sulphosuccinate, Diundecyl Potassium Sulphosuccinate, Dilauryl Potassium Sulphosuccinate, Dicocoyl Potassium Sulphosuccinate, Ditridecyl Potassium Sulphosuccinate, Dipropylheptyl Potassium Sulphosuccinate, Dicyclohexyl Potassium Sulphosuccinate, Diethylhexyl Sodium Methylsulphosuccinate, Dinonyl Sodium Methylsulphosuccinate, Diisononyl Sodium Methylsulphosuccinate, Dioctyl Sodium Methylsulphosuccinate, Diheptyl Sodium Methylsulphosuccinate, Dihexyl Sodium Methylsulphosuccinate, Dineopentyl Sodium Methylsulphosuccinate, Diisoamyl Sodium Methylsulphosuccinate, Dipentyl Sodium Methylsulphosuccinate, Diamyl Sodium Methylsulphosuccinate, Dibutyl Sodium Methylsulphosuccinate, Diisobutyl Sodium Methylsulphosuccinate, Dicapryl Sodium Methylsulphosuccinate, Didecyl Sodium Methylsulphosuccinate, Diundecyl Sodium Methylsulphosuccinate, Dilauryl Sodium Methylsulphosuccinate, Dicocoyl Sodium Methylsulphosuccinate, Ditridecyl Sodium Methylsulphosuccinate, Dipropylheptyl Sodium Methylsulphosuccinate, Dicyclohexyl Sodium Methylsulphosuccinate, with Disodium Laureth Sulphosuccinate being very particularly preferred.

Preferably, optionally alkoxylated sulphonates present as anionic surfactant in the composition according to the invention are selected from the group consisting of Sodium C14-16 Olefin Sulphonate, Sodium C12-15 Pareth-15 Sulphonate, Sodium C14-17 Alkyl sec. Sulphonate, Sodium C14 Olefin Sulphonate, Ammonium Cumenesulphonate, Ammonium Dodecylbenzenesulphonate, Calcium Dodecylbenzenesulphonate, DEA-Dodecylbenzenesulphonate, DEA-Methyl Myristate Sulphonate, Disodium Decyl Phenyl Ether Disulphonate, Disodium Lauriminobishydroxypropylsulphonate, Disodium Lauryl Phenyl Ether Di sulphonate, Isopropylamine Dodecylbenzenesulphonate, Magnesium Isododecylbenzenesulphonate, Magnesium Lauryl Hydroxypropyl Sulphonate, WA-C10-13 Alkyl Benzenesulphonate, MIPA-Dodecylbenzenesulphonate, Potassium Dodecylbenzenesulphonate, Potassium Lauryl Hydroxypropyl Sulphonate, Sodium C13-17 Alkane Sulphonate, Sodium C14-18 Alkane Sulphonate, Sodium C10-13 Alkyl Benzenesulphonate, Sodium C9-22 Alkyl Sec Sulphonate, Sodium C14-17 Alkyl Sec Sulphonate, Sodium Caproylethylformyl Benzenesulphonate, Sodium Caprylyl PG-Sulphonate, Sodium Caprylyl Sulphonate, Sodium Cocoglucosides Hydroxypropylsulphonate, Sodium Cocoglyceryl Ether Sulphonate, Sodium Cocomonoglyceride Sulphonate, Sodium C12-14 Olefin Sulphonate, Sodium C14-16 Olefin Sulphonate, Sodium C14-18 Olefin Sulphonate, Sodium C16-18 Olefin Sulphonate, Sodium C14-15 Pareth-PG Sulphonate, Sodium C12-15 Pareth-3 Sulphonate, Sodium C12-15 Pareth-7 Sulphonate, Sodium C12-15 Pareth-15 Sulphonate, Sodium Decylbenzenesulphonate, Sodium Decylglucosides Hydroxypropylsulphonate, Sodium Dodecylbenzenesulphonate, Sodium Hydroxypropyl Palm Kernelate Sulphonate, Sodium Lauroyl Hydroxypropyl Sulphonate, Sodium Laurylglucosides Hydroxypropylsulphonate, Sodium Methyl Laurate Sulphonate, Sodium Methyl Myristate Sulphonate, Sodium Methyl Palmitate Sulphonate, Sodium Methyl Stearate Sulphonate, Sodium Palm Glyceride Sulphonate, Sodium Phenylnonanoate Sulphonate, Sodium Tridecylbenzenesulphonate, TEA C14-17 Alkyl Sec Sulphonate, TEA-Dodecylbenzenesulphonate, TEA-Tridecylbenzenesulphonate.

Preferably, optionally alkoxylated glycinates present as anionic surfactant in the composition according to the invention are selected from the group consisting of Sodium Cocoyl Glycinate, Potassium Cocoyl Glycinate, Sodium Lauroyl Glycinate, Sodium Lauryl Diethylenediaminoglycinate, TEA-Cocoyl Glycinate.

Preferably, optionally alkoxylated glutamates present as anionic surfactant in the composition according to the invention are selected from the group consisting of Sodium Cocoyl Glutamate, Disodium Cocoyl Glutamate, Sodium Lauroyl Glutamate, Sodium Cocoyl Hydrolyzed Wheat Protein Glutamate, Dipotassium Capryloyl Glutamate, Dipotassium Undecylenoyl Glutamate, Disodium Capryloyl Glutamate, Disodium Cocoyl Glutamate, Disodium Hydrogenated Tallow Glutamate, Disodium Lauroyl Glutamate, Disodium Stearoyl Glutamate, Disodium Undecylenoyl Glutamate, Potassium Capryloyl Glutamate, Potassium Cocoyl Glutamate, Potassium Lauroyl Glutamate, Potassium Myristoyl Glutamate, Potassium Stearoyl Glutamate, Potassium Undecylenoyl Glutamate, Sodium Capryloyl Glutamate, Sodium Cocoyl Glutamate, Sodium Cocoyl/Hydrogenated Tallow Glutamate, Sodium Cocoyl Hydrolyzed Wheat Protein Glutamate, Sodium Cocoyl/Palmoyl/Sunfloweroyl Glutamate, Sodium Hydrogenated Tallowoyl Glutamate, Sodium Lauroyl Glutamate, Sodium Myristoyl Glutamate, Sodium Olivoyl Glutamate, Sodium Palmoyl Glutamate, Sodium Stearoyl Glutamate, Sodium Undecylenoyl Glutamate, TEA-Cocoyl Glutamate, TEA-Hydrogenated Tallowoyl Glutamate, TEA-Lauroyl Glutamate.

Preferably, optionally alkoxylated isethionates present as anionic surfactant in the composition according to the invention are selected from the group consisting of Sodium Lauroyl Methyl Isethionate, Sodium Cocoyl Isethionate, Ammonium Cocoyl Isethionate, Sodium Cocoyl Isethionate, Sodium Hydrogenated Cocoyl Methyl Isethionate, Sodium Lauroyl Isethionate, Sodium Lauroyl Methyl Isethionate, Sodium Myristoyl Isethionate, Sodium Oleoyl Isethionate, Sodium Oleyl Methyl Isethionate, Sodium Palm Kerneloyl Isethionate, Sodium Stearoyl Methyl Isethionate.

Preferably, optionally alkoxylated carboxylates present as anionic surfactant in the composition according to the invention are selected from the group consisting of C12-C22 saturated and unsaturated fatty acids and salts thereof, and also Trideceth-7 Carboxylic Acid, Sodium Laureth-13 Carboxylate, Sodium Laureth-4 Carboxylate, Laureth-11 Carboxylic Acid, Laureth-5 Carboxylic Acid, Sodium Laureth-5 Carboxylate, Ammonium Laureth-6 Carboxylate, Ammonium Laureth-8 Carboxylate, Capryleth-4 Carboxylic Acid, Capryleth-6 Carboxylic Acid, Capryleth-9 Carboxylic Acid, Ceteareth-25 Carboxylic Acid, Cetyl C12-15 Pareth-8 Carboxylate, Cetyl C12-15-Pareth-9 Carboxylate, Cetyl PPG-2 Isodeceth-7 Carboxylate, Coceth-7 Carboxylic Acid, C9-11 Pareth-6 Carboxylic Acid, C9-11 Pareth-8 Carboxylic Acid, C11-15 Pareth-7 Carboxylic Acid, C12-13 Pareth-5 Carboxylic Acid, C12-13 Pareth-7 Carboxylic Acid, C12-13 Pareth-8 Carboxylic Acid, C12-13 Pareth-12 Carboxylic Acid, C12-15 Pareth-7 Carboxylic Acid, C12-15 Pareth-8 Carboxylic Acid, C12-15 Pareth-12 Carboxylic Acid, C14-15 Pareth-8 Carboxylic Acid, Deceth-7 Carboxylic Acid, Ethylhexeth-3 Carboxylic Acid, Hexeth-4 Carboxylic Acid, Isopropyl C12-15-Pareth-9 Carboxylate, Isopropyl PPG-2 Isodeceth-7 Carboxylate, Isosteareth-6 Carboxylic Acid, Isosteareth-11 Carboxylic Acid, Laureth-3 Carboxylic Acid, Laureth-4 Carboxylic Acid, Laureth-5 Carboxylic Acid, Laureth-6 Carboxylic Acid, Laureth-8 Carboxylic Acid, Laureth-10 Carboxylic Acid, Laureth-11 Carboxylic Acid, Laureth-12 Carboxylic Acid, Laureth-13 Carboxylic Acid, Laureth-14 Carboxylic Acid, Laureth-17 Carboxylic Acid, Magnesium Laureth-11 Carboxylate, MEA-Laureth-6 Carboxylate, MEA PPG-6 Laureth-7 Carboxylate, MEA-PPG-8-Steareth-7 Carboxylate, Myreth-3 Carboxylic Acid, Myreth-5 Carboxylic Acid, Oleth-3 Carboxylic Acid, Oleth-6 Carboxylic Acid, Oleth-10 Carboxylic Acid, PEG-2 Stearamide Carboxylic Acid, PEG-9 Stearamide Carboxylic Acid, Potassium Laureth-3 Carboxylate, Potassium Laureth-4 Carboxylate, Potassium Laureth-5 Carboxylate, Potassium Laureth-6 Carboxylate, Potassium Laureth-10 Carboxylate, Potassium Trideceth-3 Carboxylate, Potassium Trideceth-4 Carboxylate, Potassium Trideceth-7 Carboxylate, Potassium Trideceth-15 Carboxylate, Potassium Trideceth-19 Carboxylate, PPG-3-Deceth-2 Carboxylic Acid, Propyl C12-15 Pareth-8 Carboxylate, Sodium Capryleth-2 Carboxylate, Sodium Capryleth-9 Carboxylate, Sodium Ceteareth-13 Carboxylate, Sodium Ceteth-13 Carboxylate, Sodium C9-11 Pareth-6 Carboxylate, Sodium C11-15 Pareth-7 Carboxylate, Sodium C12-13 Pareth-5 Carboxylate, Sodium C12-13 Pareth-8 Carboxylate, Sodium C12-13 Pareth-12 Carboxylate, Sodium C12-15 Pareth-6 Carboxylate, Sodium C12-15 Pareth-7 Carboxylate, Sodium C12-15 Pareth-8 Carboxylate, Sodium C12-15 Pareth-12 Carboxylate, Sodium C14-15 Pareth-8 Carboxylate, Sodium C12-14 Sec-Pareth-8 Carboxylate, Sodium Deceth-2 Carboxylate, Sodium Hexeth-4 Carboxylate, Sodium Isosteareth-6 Carboxylate, Sodium Isosteareth-11 Carboxylate, Sodium Laureth-3 Carboxylate, Sodium Laureth-4 Carboxylate, Sodium Laureth-5 Carboxylate, Sodium Laureth-6 Carboxylate, Sodium Laureth-8 Carboxylate, Sodium Laureth-11 Carboxylate, Sodium Laureth-12 Carboxylate, Sodium Laureth-13 Carboxylate, Sodium Laureth-14 Carboxylate, Sodium Laureth-16 Carboxylate, Sodium Laureth-17 Carboxylate, Sodium Lauryl Glucose Carboxylate, Sodium Lauryl Glycol Carboxylate, Sodium PEG-6 Cocamide Carboxylate, Sodium PEG-8 Cocamide Carboxylate, Sodium PEG-3 Lauramide Carboxylate, Sodium PEG-4 Lauramide Carboxylate, Sodium PEG-7 Olive Oil Carboxylate, Sodium PEG-8 Palm Glycerides Carboxylate, Sodium Trideceth-3 Carboxylate, Sodium Trideceth-4 Carboxylate, Sodium Trideceth-6 Carboxylate, Sodium Trideceth-7 Carboxylate, Sodium Trideceth-8 Carboxylate, Sodium Trideceth-12 Carboxylate, Sodium Trideceth-15 Carboxylate, Sodium Trideceth-19 Carboxylate, Sodium Undeceth-5 Carboxylate, Trideceth-3 Carboxylic Acid, Trideceth-4 Carboxylic Acid, Trideceth-7 Carboxylic Acid, Trideceth-8 Carboxylic Acid, Trideceth-15 Carboxylic Acid, Trideceth-19 Carboxylic Acid and Undeceth-5 Carboxylic Acid.

Preferably, optionally alkoxylated sarcosinates present as anionic surfactant in the composition according to the invention are selected from the group consisting of Sodium Lauroyl Sarcosinate, Sodium Cocoyl Sarcosinate, Sodium Myristoyl Sarcosinate, TEA-Cocoyl Sarcosinate, Ammonium Cocoyl Sarcosinate, Ammonium Lauroyl Sarcosinate, Dimer Dilinoleyl Bis-Lauroylglutamate/Lauroylsarcosinate, Disodium Lauroamphodiacetate Lauroyl Sarcosinate, Isopropyl Lauroyl Sarcosinate, Potassium Cocoyl Sarcosinate, Potassium Lauroyl Sarcosinate, Sodium Cocoyl Sarcosinate, Sodium Lauroyl Sarcosinate, Sodium Myristoyl Sarcosinate, Sodium Oleoyl Sarcosinate, Sodium Palmitoyl Sarcosinate, TEA-Cocoyl Sarcosinate, TEA-Lauroyl Sarcosinate, TEA-Oleoyl Sarcosinate, TEA-Palm Kernel Sarcosinate.

Further substances which may be present as anionic surfactant in the composition according to the invention are selected from the group consisting of Sodium Anisate, Sodium Levulinate, Sodium Coco-Glucoside Tartrate, Sodium Lauroyl Lactylate, Sodium Methyl Cocoyl Taurate, Sodium Methyl Lauroyl Taurate, Sodium Methyl Oleoyl Taurate, Sodium Cocoyl Alaninate, Sodium Laureth-4 Phosphate, Laureth-1 Phosphate, Laureth-3 Phosphate, Potassium Laureth-1 Phosphate, Sodium Lauryl Sulfoacetate and Sodium Coco Sulfoacetate, Disodium Stearyl Sulfosuccinamate, Disodium Tallow Sulfosuccinamate, Tetrasodium Dicarboxyethyl Stearyl Sulfosuccinamate, and their alkoxylated variants and mixtures thereof.

Particularly preferred anionic surfactants present are particularly the aforementioned optionally alkoxyalted sulphonates, alkyl sulphates and alkyl ether sulphates.

If the compositions are used in washing compositions, further ingredients may be included which further improve the performance and/or aesthetic properties of the detergent formulation. In particular, these include non-ionic surfactants such as fatty alcohol ethoxylates, amine oxides and alkyl polyglucosides (APGs), and also zwitterionic surfactants, such as betaines, which may further increase the stability of the enzymes. These further include substances from the group of builders, bleaches, bleach activators, perfumes, perfume carriers, fluorescent agents, dyes, foam inhibitors, silicone oils, antiredeposition agents, optical brighteners, greying inhibitors, shrink preventers, anticrease agents, color transfer inhibitors, antimicrobial active ingredients, germicides, fungicides, antioxidants, preservatives, corrosion inhibitors, antistats, bittering agents, ironing aids, phobicization and impregnation agents, swelling- and slip-resist agents, neutral filling salts, and UV absorbers.

Examples of builders, bleaches, bleach activators and bleach catalysts are described in WO 2007/115872, page 22, line 7 to page 25, line 26, of which the relevant disclosure content is explicitly incorporated as part of this disclosure by way of reference. Antiredeposition agents, optical brighteners, greying inhibitors and color transfer inhibitors are described, for example, in WO 2007/115872, page 26, line 15 to page 28, line 2, of which the relevant disclosure content is explicitly incorporated as part of this disclosure by way of reference. Examples of anticrease agents, antimicrobial active ingredients, germicides, fungicides, antioxidants, preservatives, antistats, ironing aids and UV absorbers are described by way of example in WO 2007/115872, on page 28, line 14 to page 30, line 22, of which the relevant disclosure content is explicitly incorporated as part of this disclosure by way of reference.

The compositions may optionally include further enzymes which are also stabilised by the glycolipids, e.g. (poly)esterases, lipases or lipolytically acting enzymes, amylases, cellulases or other glycosyl hydrolases, hemicellulase, cutinases, β-glucanases, oxidases, peroxidases, mannanases, perhydrolases, oxidoreductases and/or laccases.

The compositions according to the invention are preferably characterized in that the proportion of the sum total of all surfactants in the compositions according to the invention is from 0.1% by weight to 50% by weight, preferably 1 to 25% by weight, preferably 5 to 20% by weight and particularly preferably 10 to 20% by weight, wherein the percentages by weight relate to the total composition.

The proportion of biosurfactant in the total surfactant is preferably from 5% by weight to 99% by weight, preferably from 20% by weight to 95% by weight, particularly preferably from 25% by weight to 80% by weight, based on the total amount of surfactant in the composition according to the invention.

Preferred compositions according to the invention comprise water as a component D).

In a preferred embodiment, the composition according to the invention contains water in an amount from 0.001% by weight to 5% by weight, preferably 0.01% by weight to 3% by weight, particularly preferably 0.1% by weight to 2% by weight. This embodiment covers, for example, storage-stable dry cleaning agents, for example, in powder, granule or tablet form.

In an alternative preferred embodiment, the composition according to the invention contains water in an amount from 10% by weight to 95% by weight, preferably 20% by weight to 90% by weight, preferably 30% by weight to 80% by weight. This alternative embodiment covers, for example, storage-stable liquid cleaning agents.

The compositions according to the invention preferably have a pH of 4 to 12.5, preferably of 5 to 10, particularly preferably of 5.5 to 9.0.

If the compositions according to the invention are used, for example, in laundry detergents, they preferably have a pH of 7 to 12.5, preferably of 7.5 to 12, particularly preferably of 8 to 12. If the compositions according to the invention are used, for example, in manual dishwashing agents, they preferably alternatively have a pH of 4 to 8, preferably of 4.5 to 7.5, particularly preferably of 5 to 6.5.

The "pH" in connection with the present invention is defined as the value which is measured for the relevant substance at 25° C. after stirring for 5 minutes using a calibrated pH electrode in accordance with ISO 4319 (1977).

Preferred compositions according to the invention comprise at least one protease inhibitor as a component E).

Preferred protease inhibitors present are selected from the list of reversible protease inhibitors.

Frequently used as reversible protease inhibitors are benzamidine hydrochloride, borax, boric acids, boronic acids, or salts or esters thereof, especially including derivatives having aromatic groups, for example, ortho-, meta- or para-substituted phenylboronic acids, particularly 4-formylphenylboronic acid, or the salts or esters of the compounds specified. Also used for this purpose are peptide aldehydes, i.e. oligopeptides having a reduced C-terminus, particularly those composed of 2 to 50 monomers. The peptidic reversible protease inhibitors include, inter alia, ovomucoid and leupeptin. Specific, reversible peptide inhibitors of the protease subtilisin and also fusion proteins of proteases and specific peptide inhibitors are also suitable for this purpose. Particular preference is given to using boric acid and/or salts thereof as component E).

It is preferable in accordance with the invention that, if boric acid and/or salts thereof is present as component E), polyols are additionally included. These further stabilize the peptidase activity in the formulation by interaction with the boric acid and/or salts thereof and also the biosurfactants. Preferred polyols used are 1,2-propanediol, ethylene glycol, erythritan, glycerol, sorbitol, mannitol, glucose, fructose and lactose. The weight ratio of boric acid and/or salts thereof to polyols is, in accordance with the invention, in a range of 1:0.1 to 1:10, preferably 1:0.3 to 1:5.

Particularly preferred compositions according to the invention comprise

A) at least one peptidase,

B) at least one biosurfactant,

C) at least one anionic surfactant,

D) water, and

E) at least one protease inhibitor, wherein the peptidase is selected from the group of the bacillolysins of EC 3.4.24.28, the group of the thermolysins of EC 3.4.24.27 and the group of the subtilisins of EC 3.4.21.62, the biosurfactant is selected from the group comprising rhamnolipids and sophorolipids, the anionic surfactant is selected from the group comprising optionally alkoxylated sulphonates, the group of the alkyl sulphates and the group of the alkyl ether sulphates, the protease inhibitor is selected from the group comprising boric acid and salts thereof, and the components are present in an amount based on the total composition of A) 0.001% by weight to 10% by weight, preferably 0.05% by weight to 5% by weight, preferably 0.1% by weight to 3% by weight B) 0.5% by weight to 50% by weight, preferably 2% by weight to 40% by weight, preferably 5% by weight to 30% by weight C) 0.1% by weight to 40% by weight, preferably 1% by weight to 35% by weight, preferably 2% by weight to 30% by weight D) 0.001% by weight to 95% by weight, preferably 1% by weight to 90% by weight, preferably 10% by weight to 60% by weight E) 0.001% by weight to 10% by weight, preferably 0.01% by weight to 5% by weight, preferably 0.1% by weight to 3% by weight.

The present invention further relates to a method for stabilizing peptidases comprising the method steps of:

a) providing at least one peptidase and b) adding at least one biosurfactant, to obtain a peptidase-stabilized composition.

The method according to the invention is preferably carried out such that, inventive compositions which are preferred according to the invention are obtained as peptidase-stabilized compositions, The present invention further relates to the use of at least one biosurfactant for stabilizing the enzymatic activity of at least one peptidase, particularly in the compositions according to the invention.

In the case of the use according to the invention, particularly preferred embodiments of the compositions according to the invention and preferred components thereof are used in the preferred amounts.

Therefore, a particularly preferred use in accordance with the invention is characterized in that the peptidase is selected from the group comprising bacillolysins of EC 3.4.24.28, subtilisins of EC 3.4.21.62 and thermolysins of EC 3.4.24.27, and the surfactant used is selected from the group comprising rhamnolipids and sophorolipids.

The examples adduced below illustrate the present invention by way of example, without any intention of restricting the invention, the scope of application of which is apparent from the entirety of the description and the claims, to the embodiments specified in the examples.

The following figures form part of the examples:

FIG. 1: Influence of addition of sodium lauryl ether sulphate (SLES) on the storage stability of Neutrase® 0.8 L in a formulation with linear alkylbenzenesulphonate (LAS) (cf. Table 1). Plot of the activity compared to the enzyme stored in a refrigerator. SLES barely contributes to the stabilization of the enzyme.

Figure 2:
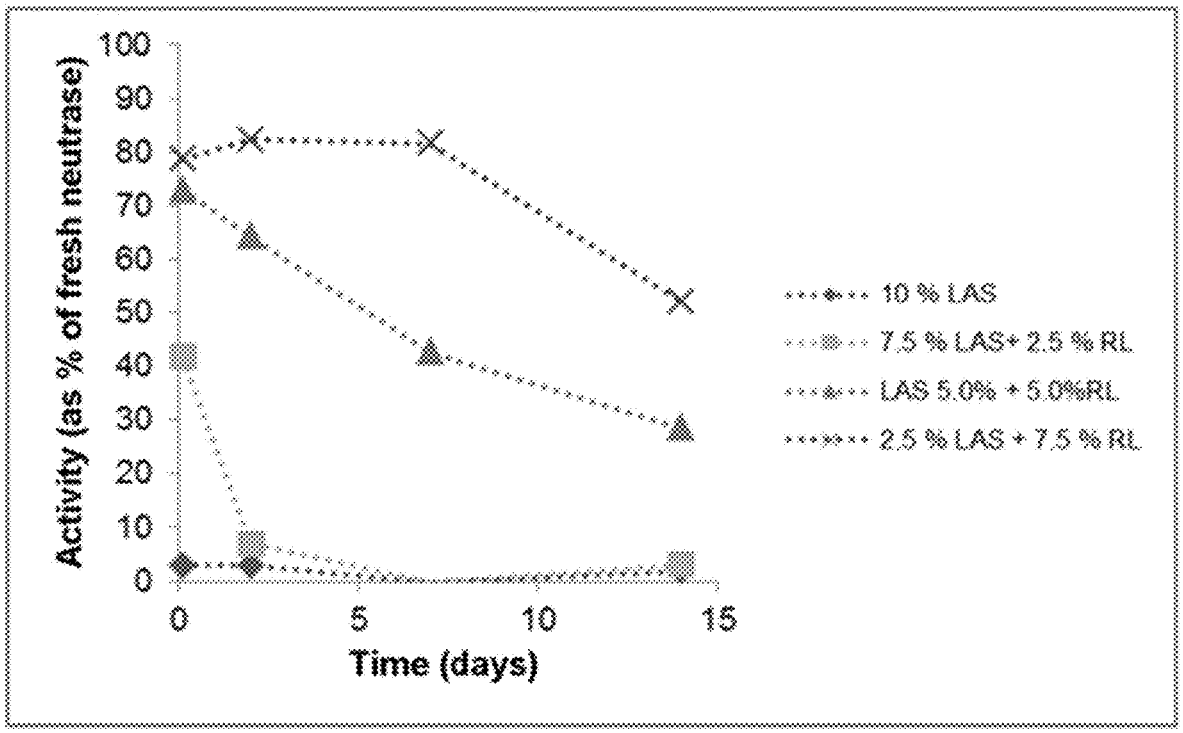
FIG. 2: Influence of addition of rhamnolipid (RL) on the storage stability of Neutrase® 0.8 L in a formulation with LAS (cf. Table 1). Plot of the activity compared to the enzyme stored in a refrigerator. The stability of the enzyme can be drastically increased by the addition of rhamnolipid.

FIG. 2: Influence of addition of rhamnolipid (RL) on the storage stability of Neutrase® 0.8 L in a formulation with LAS (cf. Table 1). Plot of the activity compared to the enzyme stored in a refrigerator. The stability of the enzyme can be drastically increased by the addition of rhamnolipid.

Figure 3:
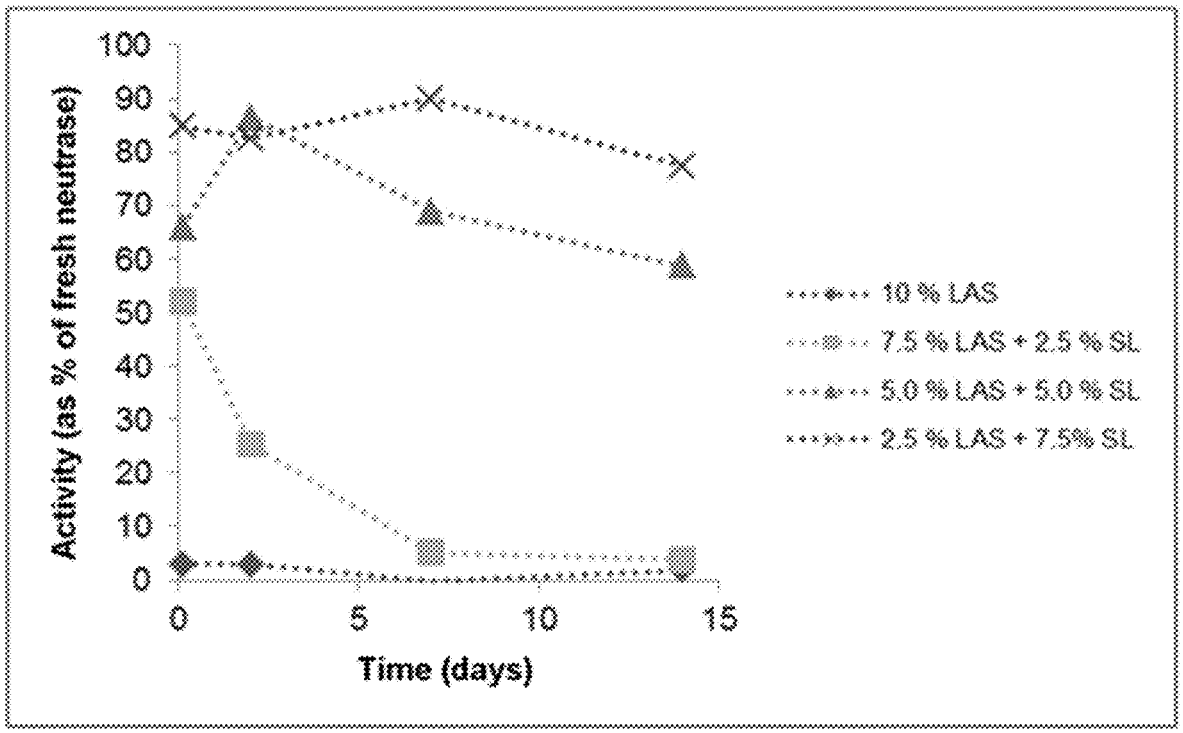
FIG. 3: Influence of addition of sophorolipid (SL) on the storage stability of Neutrase® 0.8 L in a formulation with LAS (cf. Table 1). Plot of the activity compared to the enzyme stored in a refrigerator. The stability of the enzyme can be drastically increased by the addition of sophorolipid.

FIG. 3: Influence of addition of sophorolipid (SL) on the storage stability of Neutrase® 0.8 L in a formulation with LAS (cf. Table 1). Plot of the activity compared to the enzyme stored in a refrigerator. The stability of the enzyme can be drastically increased by the addition of sophorolipid.

Figure 4:
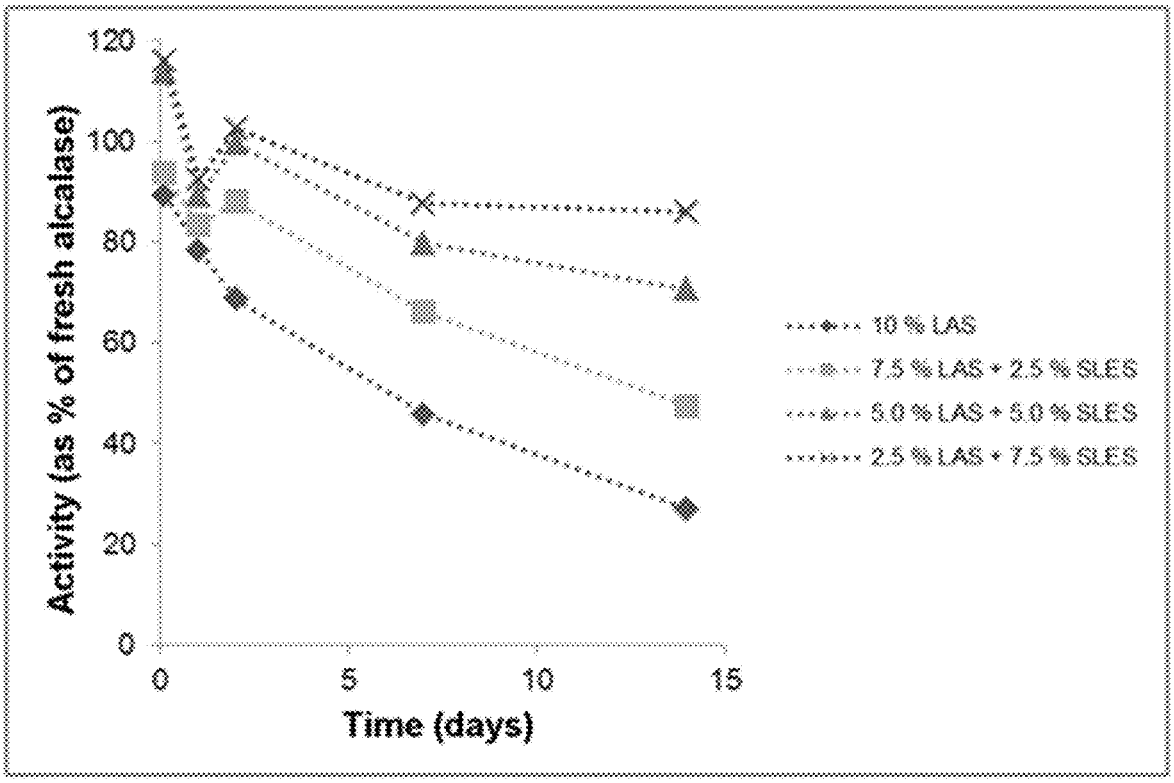
FIG. 4: Influence of addition of sodium lauryl ether sulphate (SLES) on the storage stability of Alcalase® 2.4 L FG in a formulation with LAS (cf. Table 2). Plot of the activity compared to the enzyme stored in a refrigerator. SLES contributes significantly to the stabilization of the enzyme.

FIG. 4: Influence of addition of sodium lauryl ether sulphate (SLES) on the storage stability of Alcalase® 2.4 L FG in a formulation with LAS (cf. Table 2). Plot of the activity compared to the enzyme stored in a refrigerator. SLES contributes significantly to the stabilization of the enzyme.

Figure 5:
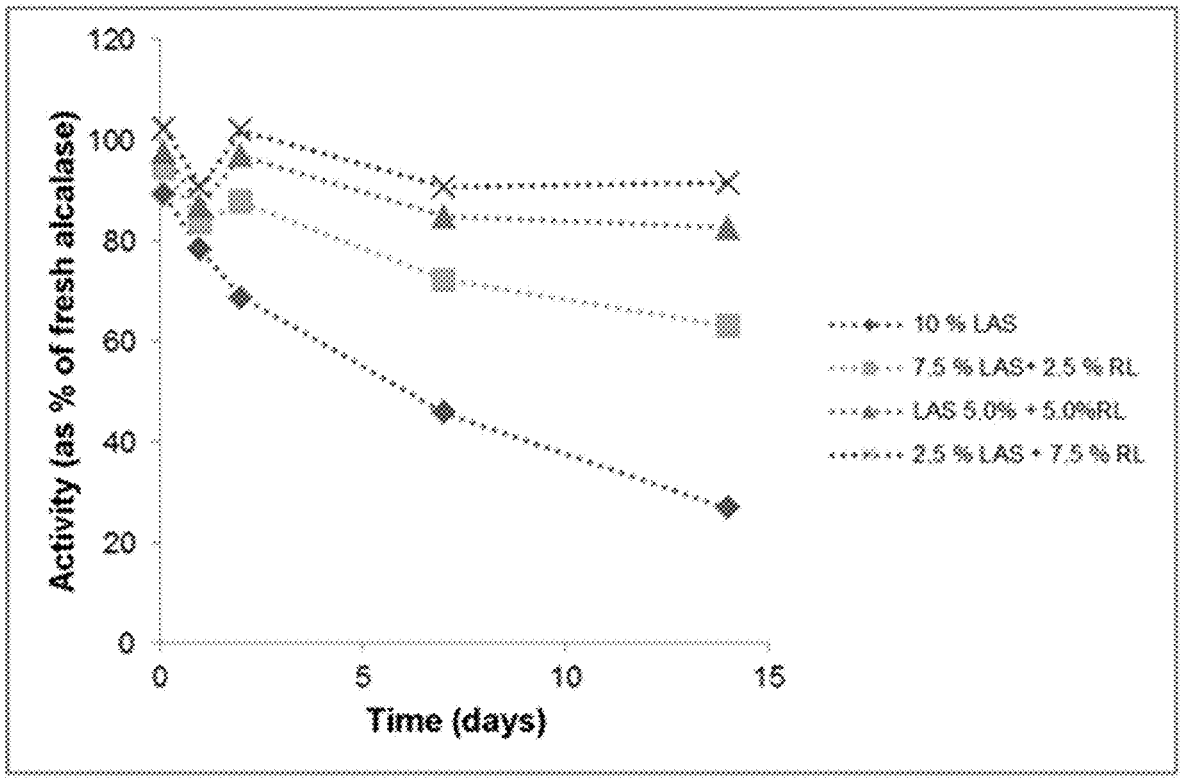
FIG. 5: Influence of addition of rhamnolipid (RL) on the storage stability of Alcalase® 2.4 L FG in a formulation with LAS (cf. Table 2). Plot of the activity compared to the enzyme stored in a refrigerator. The stabilization of the enzyme by the rhamnolipid is even more effective than with the addition of SLES (cf.

FIG. 5: Influence of addition of rhamnolipid (RL) on the storage stability of Alcalase® 2.4 L FG in a formulation with LAS (cf. Table 2). Plot of the activity compared to the enzyme stored in a refrigerator. The stabilization of the enzyme by the rhamnolipid is even more effective than with the addition of SLES (cf. FIG. 4).

Figure 6:
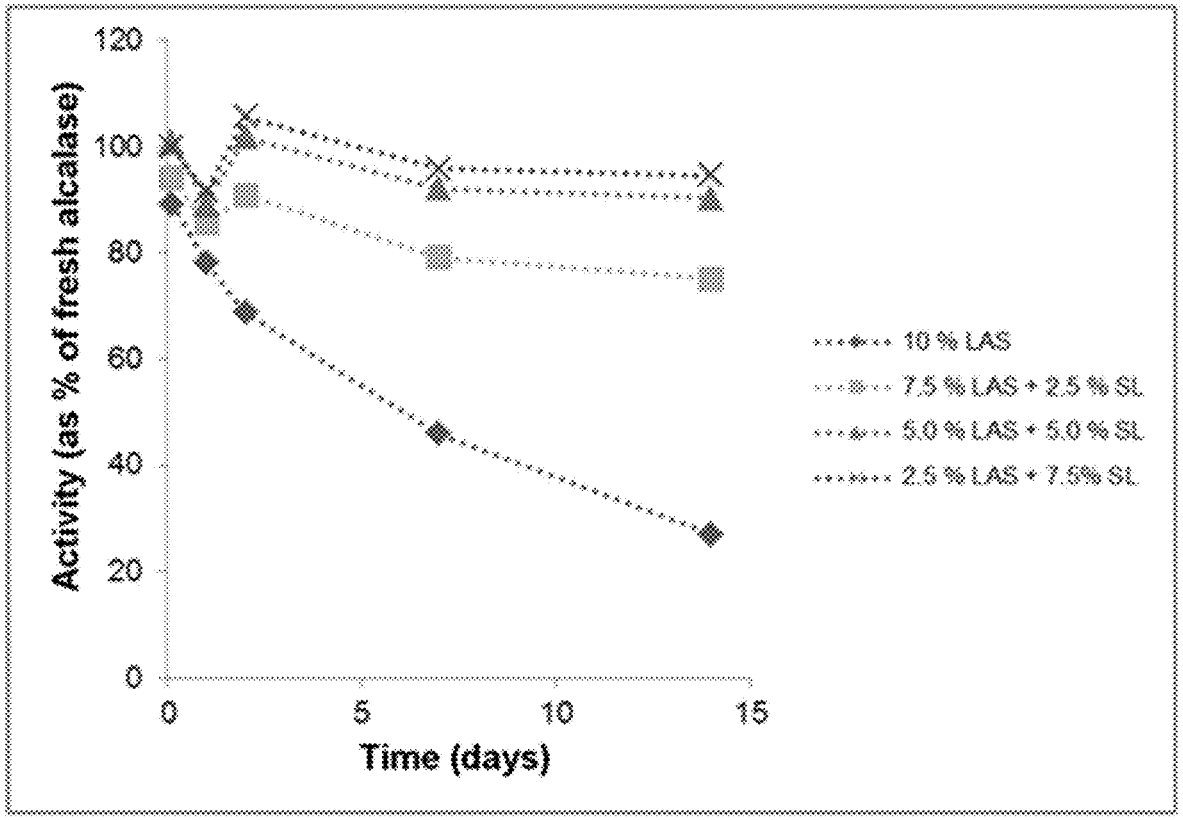
FIG. 6: Influence of addition of sophorolipid (SL) on the storage stability of Alcalase® 2.4 L FG in a formulation with LAS (cf. Table 2). Plot of the activity compared to the enzyme stored in a refrigerator. The stabilization of the enzyme by the sophorolipid is even more effective than with the addition of SLES (cf.

FIG. 6: Influence of addition of sophorolipid (SL) on the storage stability of Alcalase® 2.4 L FG in a formulation with LAS (cf. Table 2). Plot of the activity compared to the enzyme stored in a refrigerator. The stabilization of the enzyme by the sophorolipid is even more effective than with the addition of SLES (cf. FIG. 4).

Figure 7:
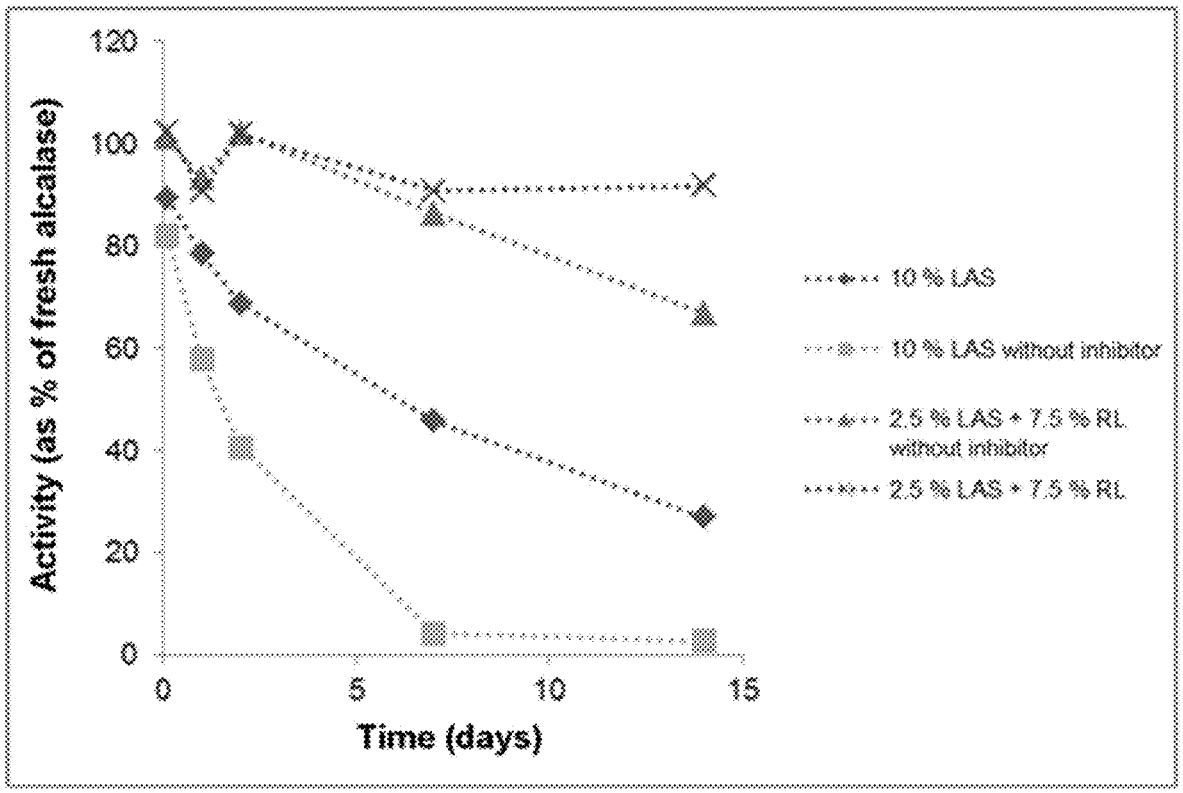
FIG. 7: Storage stability of the protease Alcalase® 2.4 L FG in the presence and in the absence of inhibitors in a formulation with LAS and in a formulation with LAS with rhamnolipid (cf. Table 3). Complete autodigestion of the protease occurs in the system with only LAS without inhibitor. In the presence of the rhamnolipid, the drop in activity is distinctly lower even without inhibitor.

FIG. 7: Storage stability of the protease Alcalase® 2.4 L FG in the presence and in the absence of inhibitors in a formulation with LAS and in a formulation with LAS with rhamnolipid (cf. Table 3). Complete autodigestion of the protease occurs in the system with only LAS without inhibitor. In the presence of the rhamnolipid, the drop in activity is distinctly lower even without inhibitor.

Figure 8:
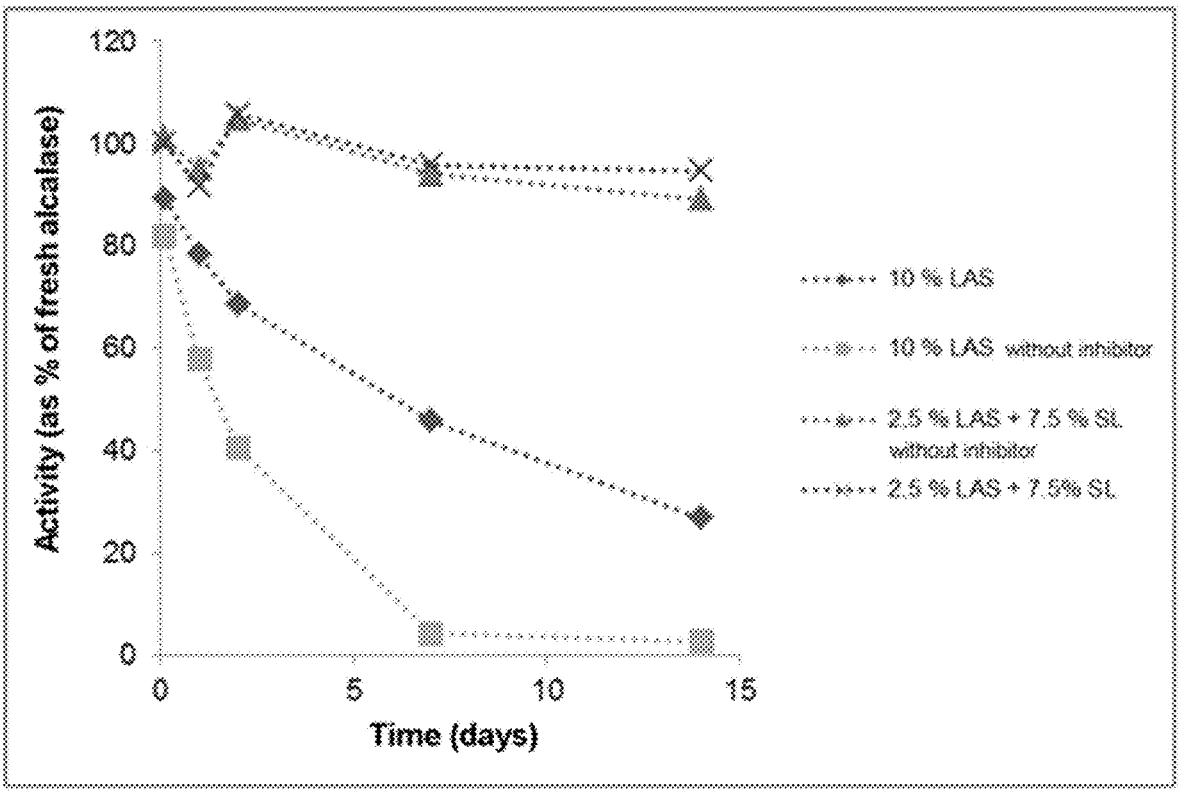
FIG. 8: Storage stability of the protease Alcalase® 2.4 L FG in the presence and in the absence of inhibitors in a formulation with LAS and in a formulation with LAS with sophorolipid (cf. Table 3). Complete autodigestion of the protease occurs in the system with only LAS without inhibitor. Hardly any drop in activity could be observed in the presence of sophorolipid even without inhibitor.

FIG. 8: Storage stability of the protease Alcalase® 2.4 L FG in the presence and in the absence of inhibitors in a formulation with LAS and in a formulation with LAS with sophorolipid (cf. Table 3). Complete autodigestion of the protease occurs in the system with only LAS without inhibitor. Hardly any drop in activity could be observed in the presence of sophorolipid even without inhibitor.

Figure 9:
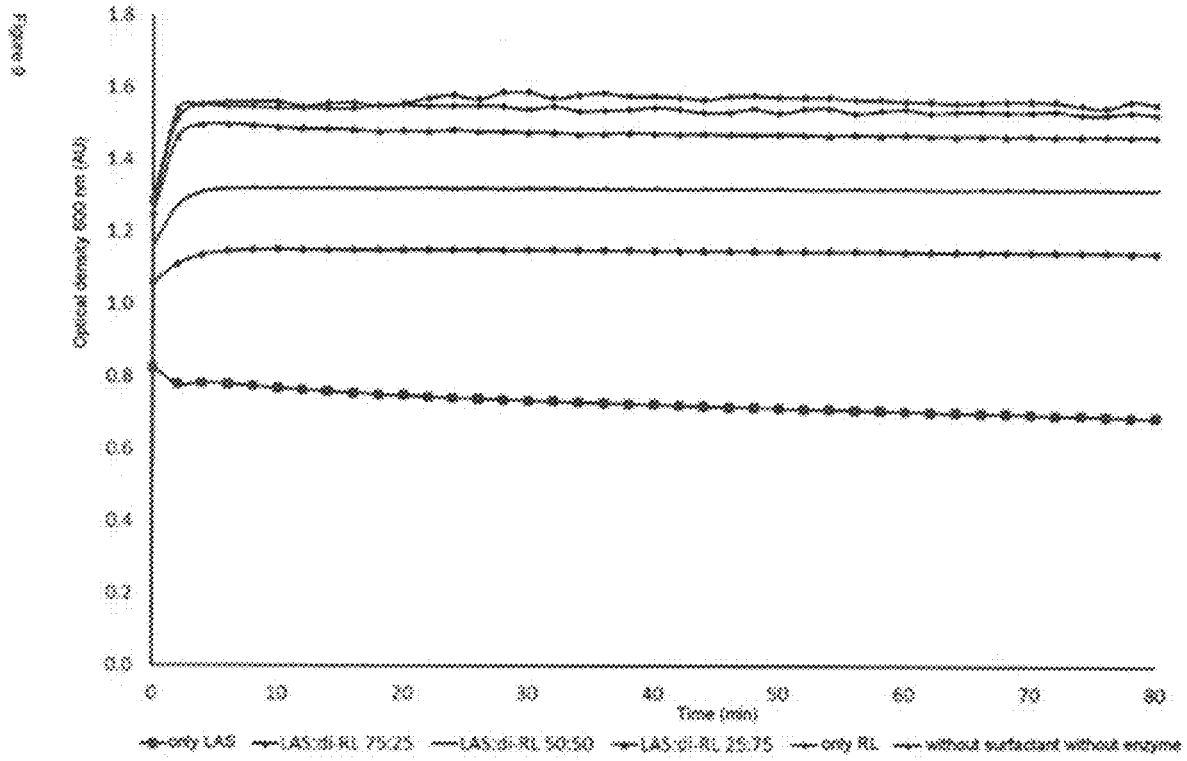
FIG. 9: Relating to Example 4. Influence of LAS, RL and mixtures of both surfactants on the solubilization of zein. Measurements of the optical density at 600 nm over time compared to zein without surfactant. The lower the optical density, the higher the fraction of solubilized zein. The total surfactant concentration was always 0.05% by weight. The proportions by weight of LAS and RL here were 100:0, 75:25, 50:50, 25:75 and 0:100.

FIG. 9: Relating to Example 4. Influence of LAS, RL and mixtures of both surfactants on the solubilization of zein. Measurements of the optical density at 600 nm over time compared to zein without surfactant. The lower the optical density, the higher the fraction of solubilized zein. The total surfactant concentration was always 0.05% by weight. The proportions by weight of LAS and RL here were 100:0, 75:25, 50:50, 25:75 and 0:100.

Figure 10:
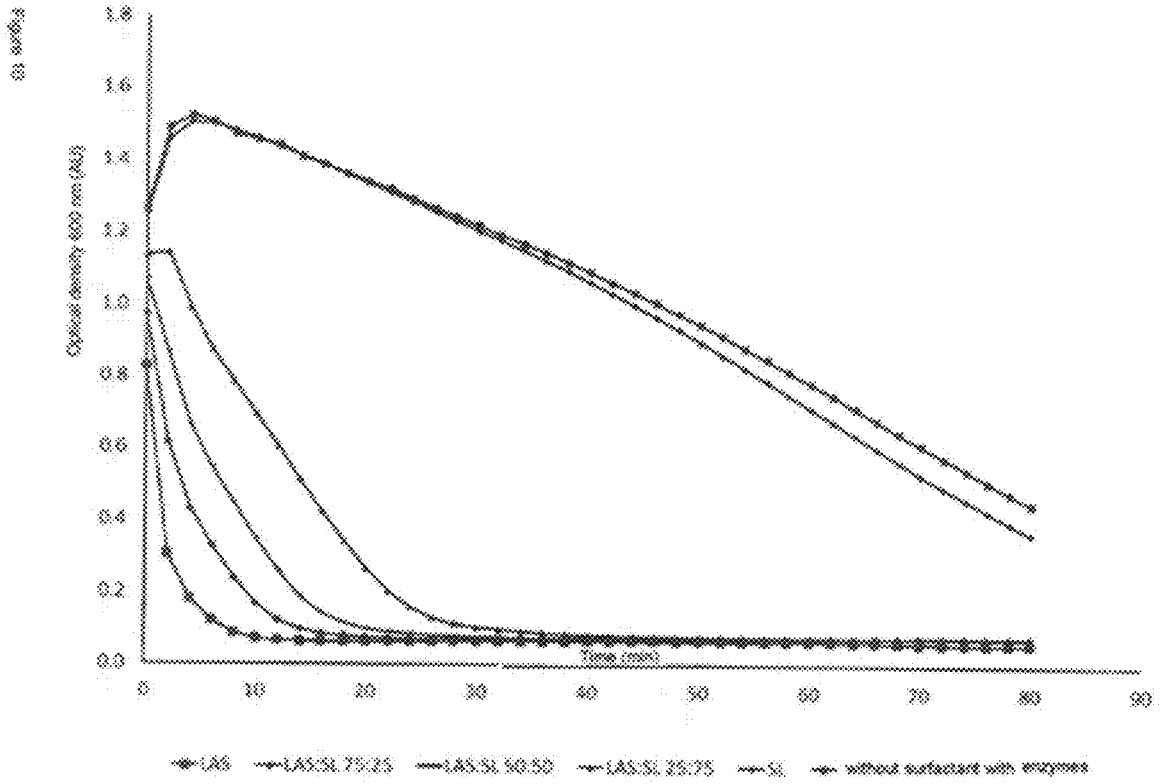
FIG. 10: Relating to Example 4. Influence of LAS, SL and mixtures of both surfactants on the solubilization of zein. Measurements of the optical density at 600 nm over time compared to zein without surfactant. The lower the optical density, the higher the fraction of solubilized zein. The total surfactant concentration was always 0.05% by weight. The proportions by weight of LAS and SL here were 100:0, 75:25, 50:50, 25:75 and 0:100.

FIG. 10: Relating to Example 4. Influence of LAS, SL and mixtures of both surfactants on the solubilization of zein. Measurements of the optical density at 600 nm over time compared to zein without surfactant. The lower the optical density, the higher the fraction of solubilized zein. The total surfactant concentration was always 0.05% by weight. The proportions by weight of LAS and SL here were 100:0, 75:25, 50:50, 25:75 and 0:100.

Figure 11:
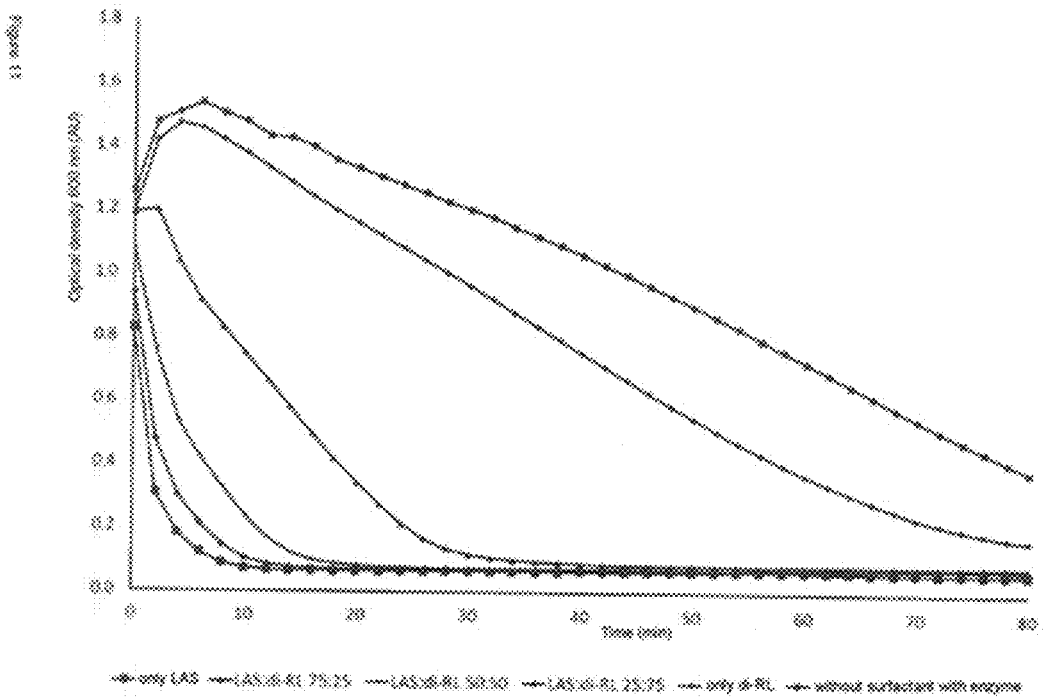
FIG. 11: Relating to Example 4. Influence of LAS, RL and mixtures of both surfactants on the solubilization of zein in combination with a protease. Measurements of the optical density at 600 nm over time compared to enzymatic solubilization of zein without surfactant. The lower the optical density, the higher the fraction of solubilized zein. The total surfactant concentration was always 0.05% by weight. The proportions by weight of LAS to RL here were 100:0, 75:25, 50:50, 25:75 and 0:100.

FIG. 11: Relating to Example 4. Influence of LAS, RL and mixtures of both surfactants on the solubilization of zein in combination with a protease. Measurements of the optical density at 600 nm over time compared to enzymatic solubilization of zein without surfactant. The lower the optical density, the higher the fraction of solubilized zein. The total surfactant concentration was always 0.05% by weight. The proportions by weight of LAS to RL here were 100:0, 75:25, 50:50, 25:75 and 0:100.

Figure 12:
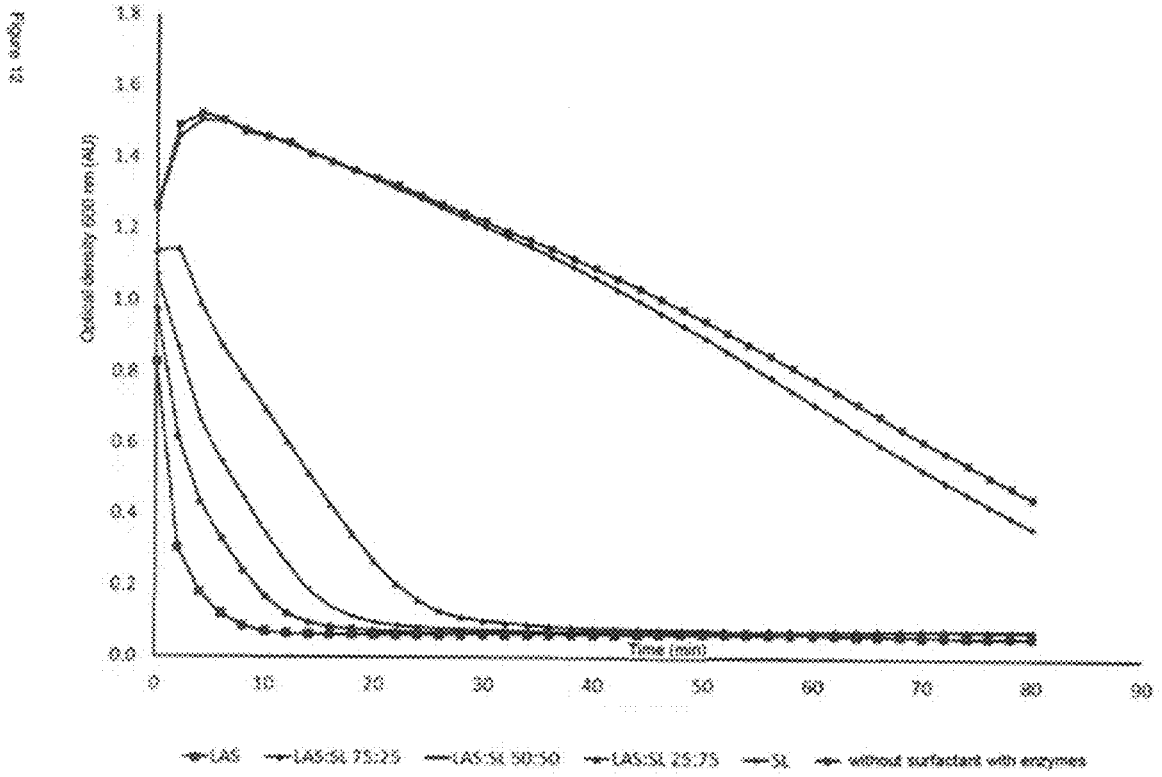
FIG. 12: Relating to Example 4. Influence of LAS, SL and mixtures of both surfactants on the solubilization of zein in combination with a protease. Measurements of the optical density at 600 nm over time compared to enzymatic solubilization of zein without surfactant. The lower the optical density, the higher the fraction of solubilized zein. The total surfactant concentration was always 0.05% by weight. The proportions by weight of LAS to SL here were 100:0, 75:25, 50:50, 25:75 and 0:100.

FIG. 12: Relating to Example 4. Influence of LAS, SL and mixtures of both surfactants on the solubilization of zein in combination with a protease. Measurements of the optical density at 600 nm over time compared to enzymatic solubilization of zein without surfactant. The lower the optical density, the higher the fraction of solubilized zein. The total surfactant concentration was always 0.05% by weight. The proportions by weight of LAS to SL here were 100:0, 75:25, 50:50, 25:75 and 0:100.

EXAMPLES

Example 1: Comparison of the Storage Stability of a Protease in Linear Alkylbenzenesulphonate (LAS), Mixtures of LAS with Sodium Lauryl Ether Sulphate (SLES), Mixtures of LAS with Rhamnolipid and Mixtures of LAS with Sophorolipid The investigations should show the stabilising effect of SLES, rhamnolipid and sophorolipid on the proteases Neutrase and Alcalase in the presence of LAS. For investigations of the storage stability, surfactant mixtures were prepared in a 0.1M triethanolamine buffer (TEA) pH=8. The protease inhibitors propane-1,2-diol and boric acid were also added. The mixtures were adjusted to pH=8 by adding acid or base as needed. Proteases from liquid preparations were added to the relevant mixtures, mixed and the mixtures stored at 30° C. (cf. Table 1 and 2). The proteases were the products Neutrase® 0.8 L and Alcalase® 2.4 L FG (a subtilisin). Samples were taken at various timepoints from these compositions and diluted 100-fold with 0.1M phosphate buffer, pH=7. 100 μl of each of these diluted solutions were pipetted into the wells of a 96-well microtitre plate. To these were then added 100 μl of a 0.4 mg/ml solution of the substrate N-succinyl-Ala-Ala-Pro-Phe p-nitroanilide (Sigma Aldrich) in 0.1 M phosphate buffer, pH=7, and the enzyme activity measured in a microtitre plate reader (Tecan, Infitite® M200 Pro) at 410 nm via hydrolysis of the substrate at 37° C. The activity was calculated from the initial slope and is related to the enzyme activity of the enzyme stored in a refrigerator.

The following mixture was used as rhamnolipids in all examples:

Rhamnolipid species verified by HPLC were:

| | |
|---|---|
| RL total [%] (HPLC) | 91 |
| diRL-C8C10 | 13.9 |
| monoRL-C8C10 | 0.51 |
| diRL-C10C10 | 61.4 |
| monoRL-C10C10 | 1.4 |
| diRL-C10C12:1 | 5.9 |
| diRL-C10C12 | 5.5 |
| other RL | 2.2 |

The sophorolipids used in all examples were a sophorolipid from Ecover having an acid to lactone ratio of 60:40.

TABLE 1

Compositions in % by weight of the proportions in 0.1M TEA buffer. The pH of the compositions was adjusted to pH = 8.

| Composition | 1.1 | 1.2 | 1.3 | 1.4 |
|---|---|---|---|---|
| Linear alkylbenzenesulphonate (Marlon ARL, Sassol) | 10 | 7.5 | 5 | 2.5 |
| Rhamnolipid or Sophorolipid or SLES | — | 2.5 | 5 | 7.5 |
| Propane-1,2-diol | 2.1 | 2.1 | 2.1 | 2.1 |
| Boric acid | 1.6 | 1.6 | 1.6 | 1.6 |
| Neolone PE | 0.4 | 0.4 | 0.4 | 0.4 |
| Neutrase ® 0.8 L | 10 | 10 | 10 | 10 |

TABLE 2

Compositions comprising LAS with and without various stabilising surfactants and Alcalase ® 2.4 L FG. Data in % by weight of the proportions in 0.1M TEA buffer. The pH of the compositions was adjusted to pH = 8.

| Composition | 2.1 | 2.2 | 2.3 | 2.4 |
|---|---|---|---|---|
| Linear alkylbenzenesulphonate (Marlon ARL, Sassol) | 10 | 7.5 | 5 | 2.5 |
| Rhamnolipid or Sophorolipid or SLES | — | 2.5 | 5 | 7.5 |
| Propane-1,2-diol | 2.1 | 2.1 | 2.1 | 2.1 |
| Boric acid | 1.6 | 1.6 | 1.6 | 1.6 |
| Neolone PE | 0.4 | 0.4 | 0.4 | 0.4 |
| Alcalase ® 2.4 L FG | 0.1 | 0.1 | 0.1 | 0.1 |

Example 2: Increased Enzyme Stability in the Absence of a Protease Inhibitor

The storage stability tests and activity measurements were carried out analogously to Example 1. Additional compositions were made up in which the protease inhibitors propane-1,2-diol and boric acid were not added.

TABLE 3

Compositions comprising LAS with and without various stabilising surfactants, polyol, inhibitor and Alcalase ® 2.4 L FG. Data in % by weight of the proportions in 0.1M TEA buffer. The pH of the compositions was adjusted to pH = 8.

| Composition | 3.1 | 3.2 | 3.3 | 3.4 |
|---|---|---|---|---|
| Linear alkylbenzenesulphonate (Marlon ARL, Sassol) | 10 | 10 | 2.5 | 2.5 |

TABLE 3-continued

Compositions comprising LAS with and without various stabilising surfactants, polyol, inhibitor and Alcalase ® 2.4 L FG. Data in % by weight of the proportions in 0.1M TEA buffer. The pH of the compositions was adjusted to pH = 8.

| Composition | 3.1 | 3.2 | 3.3 | 3.4 |
|---|---|---|---|---|
| Rhamnolipid or Sophorolipid | — | — | 7.5 | 7.5 |
| Propane-1,2-diol | 2.1 | — | 2.1 | — |
| Boric acid | 1.6 | — | 1.6 | — |
| Neolone PE | 0.4 | 0.4 | 0.4 | 0.4 |
| Alcalase ® 2.4 L FG | 0.1 | 0.1 | 0.1 | 0.1 |

Example 3: Example Formulations

3.1 Powder Detergent 1

| | |
|---|---|
| Sophorolipid: | 12.0 |
| Linear sodium alkylbenzenesulphonate | 5.3% |
| Fatty alcohol ethoxylate C12-18 (7 EO) | 2.0% |
| Sodium salts of fatty acids | 2.1% |
| Antifoam DC2-4248S | 5.0% |
| Zeolite 4A | 36.3% |
| Sodium carbonate | 14.9% |
| Sodium salt of acrylic-maleic acid copolymer (Sokalan CP5) | 3.1% |
| Sodium silicate | 3.8% |
| Carboxymethylcellulose | 1.5% |
| Dequest 2066 (Phosphonate) | 3.6% |
| Optical brighteners | 0.3% |
| Protease (Savinase 8.0) | 0.5% |
| Sodium perborate monohydrate | 1.0% |
| Sodium sulphate | Remainder |

3.2 Powder Detergent 2

| | |
|---|---|
| Rhamnolipid | 12.0 |
| Linear sodium alkylbenzenesulphonate | 5.3% |
| Fatty alcohol ethoxylate C12-C18 (7 EO) | 2.0% |
| Sodium salts of fatty acids | 2.1% |
| Antifoam DC2-4248S | 5.0% |
| Zeolite 4A | 36.3% |
| Sodium carbonate | 14.9% |
| Sodium salt of acrylic-maleic acid copolymer (Sokalan CP5) | 3.1% |
| Sodium silicate | 3.8% |
| Carboxymethylcellulose | 1.5% |
| Dequest 2066 (Phosphonate) | 3.6% |
| Optical brighteners | 0.3% |
| Protease (Savinase 8.0) | 0.5% |
| Sodium perborate monohydrate | 1.0% |
| Sodium sulphate | Remainder |

3.3. Liquid Detergent 1

| | |
|---|---|
| Sophorolipid | 6.0% |
| Linear sodium alkylbenzenesulphonate | 4.0% |
| Fatty alcohol ethoxylate C12-18 (7 EO) | 5.0% |
| Fatty acid | 1.0% |
| Phosphonates | 0.5% |
| Propanediol | 5.0% |
| Protease (Alcalase ® 2.4 L FG) | 1% |
| 1,2-Benzisothiazoline-3-one ('BIT', e.g. "Proxel") | 100 ppm |
| Sodium hydroxide | --> pH 8.5 |
| Demineralized water | Remainder |

3.4. Liquid Detergent 2

| | |
|---|---|
| Rhamnolipid | 6.0% |
| Linear sodium alkylbenzenesulphonate | 4.0% |
| Fatty alcohol ethoxylate C12-18 (7 EO) | 5.0% |
| Fatty acid | 1.0% |
| Phosphonates | 0.5% |
| Propanediol | 5.0% |
| Protease (Alcalase ® 2.4 L FG) | 1% |
| 1,2-Benzisothiazoline-3-one ('BIT', e.g. "Proxel") | 100 ppm |
| Sodium hydroxide | --> pH 8.5 |
| Demineralized water | Remainder |

3.5. Liquid Detergent Concentrate 1

| | |
|---|---|
| Rhamnolipid | 30.0% |
| Sodium lauryl ether sulphate | 10.0% |
| Linear sodium alkylbenzenesulphonate | 5.0% |
| Phosphonates | 0.5% |
| Sodium metaborate | 1.0% |
| Propanediol | 2.0% |
| Protease (Alcalase ® 2.4 L FG) | 1% |
| Lipase | 1% |
| Amylase | 1% |
| Fragrances | 0.5% |
| 1,2-Benzisothiazoline-3-one ('BIT', e.g. "Proxel") | 100 ppm |
| Sodium hydroxide | --> pH 8.5 |
| Demineralized water | Remainder |

3.6. Liquid Detergent Concentrate 2

| | |
|---|---|
| Sophorolipid | 30.0% |
| Sodium lauryl ether sulphate | 10.0% |
| Linear sodium alkylbenzenesulphonate | 5.0% |
| Phosphonates | 0.5% |
| Sodium metaborate | 1.0% |
| Propanediol | 2.0% |
| Protease (Alcalase ® 2.4 L FG) | 1% |
| Lipase | 1% |
| Amylase | 1% |
| Fragrances | 0.5% |
| 1,2-Benzisothiazoline-3-one ('BIT', e.g. "Proxel") | 100 ppm |
| Sodium hydroxide | --> pH 8.5 |
| Demineralized water | Remainder |

Example 4: Improved Protein Solubilization by Adding Anionic Surfactant to Biosurfactant In addition to the sufficient storage stability of the enzymes in liquid detergent formulations, the activity of peptidases or proteases in the application is of crucial significance. In the interaction with the surfactants, they contribute to the solubilization of water-insoluble proteins and water-insoluble protein soil.

Various surfactant mixtures were used singly and in combination with a protease in order to investigate the solubilization of the water-insoluble but water-dispersible model protein zein. Zein is a mixture of storage proteins from maize corn.

All solutions/dispersions were prepared in 0.1 M TEA buffer, pH=8. A stock dispersion of 0.5% by weight zein (Sigma-Aldrich) was prepared by treatment with ultrasound in an ultrasonic bath for 30 min and was further stirred on a magnetic stirrer in order to keep the zein particles in homogeneous dispersion for the sampling. A 10% by weight Alcalase® 2.4 L FG stock solution was likewise prepared. Surfactant stock solutions consisting of linear alkylbenzene sulphonate (LAS, Marlon ARL, Sassol) and biosurfactant having a total surfactant content of 0.11% by weight were prepared. The proportions by weight of linear LAS and biosurfactant here were 100:0, 75:25, 50:50, 25:75 and 0:100. Surfactant, enzyme and zein stock solutions were mixed in microtitre plates (220 μl total volume of liquid) and the turbidity measured at 600 nm (OD 600) in a microtitre plate reader (Tecan, Infitite® M200 Pro). The following concentrations were established: 0.25% by weight zein, 0.05% by weight surfactant (mixture), 0.45% Alcalase® 2.4 L FG. Surfactant mixture and enzyme were initially charged and then the reaction started by addition of the zein dispersion. All solutions and measurements in the microtitre plate reader were temperature controlled at 25° C. The change in turbidity was measured once per minute over a period of 80 minutes. The plate was shaken in the reader for 10 seconds between the individual measurements. The decreasing turbidity can be a result of solubilization of the zein.

The addition of surfactants alone led to a partial solubilization of the zein dispersion. (FIGS. 9 and 10). The addition of protease without surfactant led to a slow but virtually complete solubilization (FIGS. 10 and 11). The addition of biosurfactant and protease led to a slightly accelerated solubilization compared to the enzyme without surfactant. With increasing LAS (proportion based on the total amount of surfactant), the solubilization was increasingly accelerated. This corresponds to a synergistic effect between protease and surfactant (mixture) in the protein solubilization. A mixture of LAS and biosurfactant is thus optimal in order to achieve a rapid protein solubilization in combination with a protease and at the same time to obtain as high storage stability as possible of the protease in the surfactant mixture. This composition is additionally described in Table 4.

TABLE 4

Influence of various ratios of LAS:biosurfactant mixture on the storage stability of a protease and the solubilization of protein soil by the surfactant mixture in combination with a protease.

| LAS:biosurfactant proportion in the total surfactant | Storage stability of the protease in the surfactant (mixture) | Solubilization of protein soil by surfactant mixture and protease |
|---|---|---|
| 100:0 (non-inventive) | Poor | Very rapid |
| 75:25 | Better | Very rapid |
| 50:50 | Good | Rapid |
| 25:75 | Very good | Rapid |
| 0:100 (non-inventive) | Very good | Slow |

The invention claimed is:

1. A composition comprising

A) from 0.1 wt % to 3 wt % of a peptidase selected from the group consisting of the trypsins and chymotrypsin proteases of EC 3.4.21.1, EC 3.4.21.2, and EC 3.4.21.4, B) from 5 wt % to 30 wt % of a biosurfactant rhamnolipids wherein rhamnolipid is a compound of Formula (I) or salts thereof Formula (I)

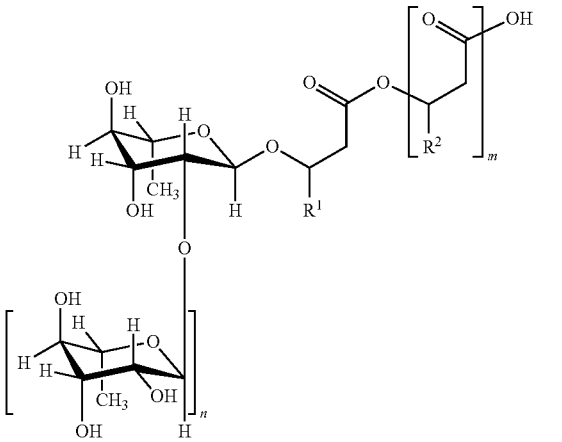

wherein m=2, 1 or 0 n=1 or 0, $R^1$ and $R^2$ are organic residues having 2 to 24 carbon atoms,

C) from 2 wt % to 30 wt % of an anionic surfactant having the properties at pH of 7 and 20° C., at least 90 mol % of the anionic surfactant molecules have at least one negatively charged group and no isoelectric point of $pH_{IEP}$-2-12 at 25° C., and D) from 10 wt % to 95 wt % of water.

2. The composition according to claim 1, wherein n=1 and $R^1$ and $R^2$ are organic residues selected from the group consisting of pentenyl, heptenyl, nonenyl, undecenyl and tridecenyl and $(CH_2)_o$—$CH_3$ where o=1 to 23.

3. The composition according to claim 1, wherein the anionic surfactant is selected from the group consisting of alkyl sulphates, alkyl ether sulphates, alkoxylated sulphosuccinates, alkoxylated methyl sulphosuccinates, alkoxylated sulphonates, alkoxylated glycinates, alkoxylated glutamates, alkoxylated isethionates, alkoxylated carboxylates, alkoxylated anisates, alkoxylated levulinates, alkoxylated tartrates, alkoxylated lactylates, alkoxylated taurates, alkoxylated alaninates, alkoxylated phosphates, alkoxylated sulphoacetates, alkoxylated sulphosuccinamates, alkoxylated sarcosinates, and alkoxylated phosphonates.

4. The composition according to claim 1, wherein the proportion of the sum total of all surfactants is from 0.1% by weight to 50% by weight, wherein the percentages by weight relate to the total composition, wherein n=1, and $R^1$ and $R^2$ are organic residues selected from the group consisting of pentenyl, heptenyl, nonenyl, undecenyl and tridecenyl and $(CH_2)_o$—$CH_3$ where o=4 to 12.

5. The composition according to claim 1, wherein the proportion of biosurfactant in the total surfactant is from 5% by weight to 99% by weight, based on the total amount of surfactant in the composition.

6. The composition according to claim 1 further comprising

E) at least one protease inhibitor.

7. The composition according to claim 6 as protease inhibitor comprising boric acid and/or salts thereof.

8. The composition according to claim 2, wherein the anionic surfactant is selected from the group consisting of alkyl sulphates, alkyl ether sulphates, alkoxylated sulphosuccinates, alkoxylated methyl sulphosuccinates, alkoxylated sulphonates, alkoxylated glycinates, alkoxylated glutamates, alkoxylated isethionates, alkoxylated carboxylates, alkoxylated anisates, alkoxylated levulinates, alkoxylated tartrates, alkoxylated lactylates, alkoxylated taurates, alkoxylated alaninates, alkoxylated phosphates, alkoxylated sulphoacetates, alkoxylated sulphosuccinamates, alkoxylated sarcosinates, and alkoxylated phosphonates.

9. The composition according to claim 1, wherein the proportion of the sum total of all surfactants is from 1% by weight to 25% by weight, wherein the percentages by weight relate to the total composition.

10. The composition according to claim 1, wherein the proportion of biosurfactant in the total surfactant is from 5% by weight to 99% by weight, based on the total amount of surfactant in the composition.

11. The composition according to claim 1, wherein the proportion of biosurfactant in the total surfactant is from 20% by weight to 95% by weight, based on the total amount of surfactant in the composition.

12. The composition according to claim 1, wherein the proportion of biosurfactant in the total surfactant is from 25% by weight to 80% by weight, based on the total amount of surfactant in the composition.

13. The composition according to claim 1, wherein the proportion of rhamnolipid in the total surfactant is from 5% by weight to 99% by weight, based on the total amount of surfactant in the composition.

* * * * *